US008388400B2

(12) United States Patent
Aoki et al.

(10) Patent No.: US 8,388,400 B2
(45) Date of Patent: Mar. 5, 2013

(54) METHOD OF FABRICATING ELECTRON-EMITTING DEVICE AND METHOD OF MANUFACTURING IMAGE DISPLAY APPARATUS

(75) Inventors: Naofumi Aoki, Chigasaki (JP); Shoji Nishida, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 596 days.

(21) Appl. No.: 12/627,982

(22) Filed: Nov. 30, 2009

(65) Prior Publication Data

US 2010/0136869 A1 Jun. 3, 2010

(30) Foreign Application Priority Data

Dec. 2, 2008 (JP) ..... 2008-307586
Sep. 18, 2009 (JP) ..... 2009-217330

(51) Int. Cl.
*H01J 1/304* (2006.01)
*H01J 1/30* (2006.01)

(52) U.S. Cl. ..... 445/51; 445/23; 445/24; 445/25; 445/50; 313/311

(58) Field of Classification Search ..... 313/309–311, 313/495–497, 346 R; 445/23–25, 50, 51
See application file for complete search history.

(56) References Cited

U.S. PATENT DOCUMENTS 4,008,412 A 2/1977 Yuito
6,091,190 A * 7/2000 Chalamala et al. ..... 313/346 R

FOREIGN PATENT DOCUMENTS

| | | | |
|---|---|---|---|
| CN | 1237270 | A | 12/1999 |
| EP | 535953 | A2 | 4/1993 |
| EP | 2194557 | A2 | 6/2010 |
| JP | 1-235124 | A | 9/1989 |
| JP | H01-235124 | A | 9/1989 |
| JP | 02-220337 | A | 9/1990 |
| JP | 2-220337 | A | 9/1990 |
| JP | 05-198253 | A | 8/1993 |
| JP | 07-078553 | A | 3/1995 |
| JP | 7-078553 | A | 3/1995 |
| JP | 07078553 | A * | 3/1995 |
| JP | 2001-167693 | A | 6/2001 |
| RU | 2159478 | C2 | 11/2000 |
| RU | 2007112860 | A | 10/2008 |
| SU | 439028 | A | 8/1974 |
| SU | 1069029 | A | 1/1984 |

* cited by examiner

*Primary Examiner* — Karabi Guharay
*Assistant Examiner* — Nathaniel Lee
(74) *Attorney, Agent, or Firm* — Canon U.S.A., Inc. IP Division

(57) ABSTRACT

The following method is provided: a method of readily fabricating an electron-emitting device, coated with a low-work function material, having good electron-emitting properties with high reproducibility such that differences in electron-emitting properties between electron-emitting devices are reduced. Before a structure is coated with the low-work function material, a metal oxide layer is formed on the structure.

2 Claims, 9 Drawing Sheets

METHOD OF FABRICATING ELECTRON-EMITTING DEVICE AND METHOD OF MANUFACTURING IMAGE DISPLAY APPARATUS

BACKGROUND OF THE INVENTION

1. Field of the Invention

The present invention relates to a method of fabricating electron-emitting device containing a low-work function material, a method of manufacturing an electron source, and a method of manufacturing an image display apparatus.

2. Description of the Related Art

For field emission-type electron-emitting devices, voltages are usually applied between electron-emitting members and gate electrodes and therefore strong electric fields are generated at the tips of the electron-emitting members, whereby electrons are emitted from the tips of electron-emitting members into vacuum.

In the field emission-type electron-emitting devices, electric fields that emit electrons are significantly affected by the surface work function and tip shape of the electron-emitting members. In theory, electron-emitting members with lower surface work function can probably emit electrons with weaker electric fields.

The following documents each disclose an electron-emitting device including an electron-emitting member formed by providing a layer made of a low-work function material on a conductive member: Japanese Patent Laid-Open No. 1-235124 (hereinafter referred to as Patent Document 1), U.S. Pat. No. 4,008,412 (hereinafter referred to as Patent Document 2), and Japanese Patent Laid-Open No. 2-220337 (hereinafter referred to as Patent Document 3).

Japanese Patent Laid-Open No. 7-78553 (hereinafter referred to as Patent Document 4) discloses a field emission micro-cathode device.

An electron source can be configured by arranging a large number of field emission-type electron-emitting devices on a substrate (back plate). An image display apparatus can be configured in such a manner that the substrate is placed opposite a substrate (front plate), as well as a CRT, including a light-emitting member such as a phosphor which emits light when being irradiated with an electron beam and peripheral portions of the substrates are then sealed.

SUMMARY OF THE INVENTION

The present invention provides a method of fabricating electron-emitting device including an electron-emitting member which includes a structure containing a metal and a low-work function layer, made of a material with a work function less than that of the metal, overlying the structure and which field-emits electrons from a surface thereof. The method includes providing a structure on which a metal oxide layer containing an oxide of a same metal as the metal contained in the structure has been formed and providing the low-work function layer on the metal oxide layer.

Further features of the present invention will become apparent from the following description of exemplary embodiments with reference to the attached drawings.

DESCRIPTION OF THE EMBODIMENTS

Figure 1A:
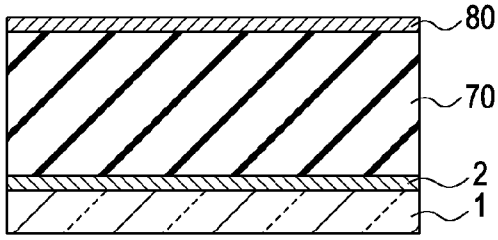
FIGS. 1A to 1H are schematic views illustrating steps of a method of fabricating an electron-emitting device according to a first embodiment of the present invention.

Various embodiment of the present invention will now be exemplarily described in detail with reference to the attached drawings. Dimensions, materials, shapes, arrangements of members described in the embodiments are not intended to limit the scope of the present invention unless otherwise specified.

When an oxide is referred to as a "metal oxide", an "oxide of a metal", or an "oxidized metal", the oxidation number of a metal is not particularly limited. That is, a "metal oxide", an "oxide of a metal", or an "oxidized metal" is represented by $MO_X$, wherein M is a metal element and x is a positive number. When the oxidation number of a metal is limited, a term such as "metal dioxide" or "$MO_2$" is used such that the oxidation number thereof can be specified. For example, the term "oxide of tungsten" or "tungsten oxide" herein covers tungsten trioxide and tungsten dioxide. This applies to elements, such as semiconductor elements, other than metal elements and also applies to compounds, such as borides, other than oxides.

An exemplary method of fabricating an electron-emitting device 10 according to a first embodiment of the present invention and an example of the configuration of the electron-emitting device 10 will now be described with reference to FIGS. 1 and 2. The electron-emitting device 10 includes a structure 3 with a conical shape.

The electron-emitting device 10 is obtained through steps shown in FIG. 1. FIG. 2 is a schematic sectional view of the electron-emitting device 10. As shown in FIG. 2, a cathode electrode 2 is disposed on a substrate 1. The structure 3 contains a metal and is electrically connected to the cathode electrode 2. The electron-emitting device 10 further includes a metal oxide layer 4 and a low-work function layer 5 disposed on the metal oxide layer 4. In other words, the metal oxide layer 4 is disposed between the structure 3 and the low-work function layer 5. The low-work function layer 5 is made of a material with a work function less than that of the metal contained in the structure 3. The structure 3, the metal oxide layer 4, and the low-work function layer 5 can be collectively referred to as an electron-emitting member 9. Therefore, the electron-emitting member 9 is electrically connected to the cathode electrode 2.

The structure 3 is a metal-containing member and is not particularly limited. The term "metal-containing member" as used herein means a member containing a single metal element or an alloy that is a mixture of metal elements. The structure 3 may be made only of the metal or an alloy, excluding impurities. The metal is herein conductive.

Figure 1B:
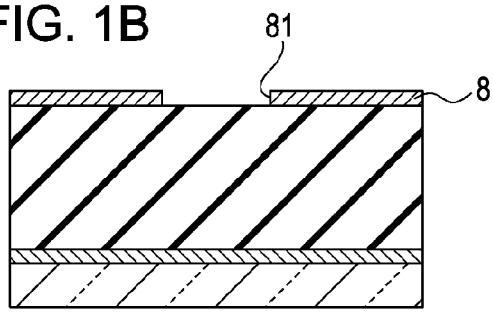
Figure 1C:
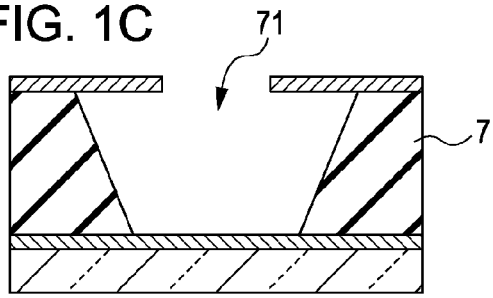
Figure 1D:
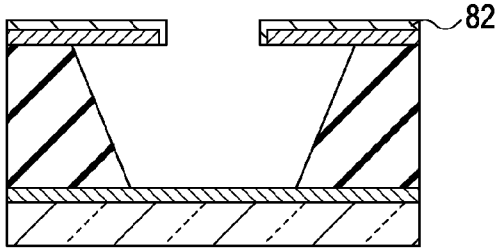
Figure 1E:
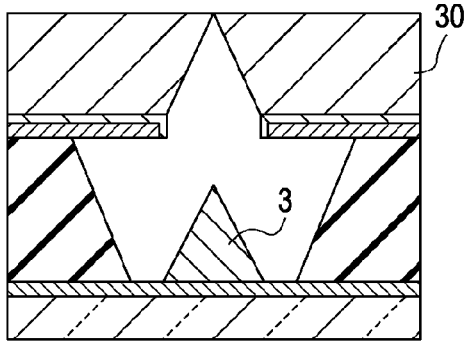
Figure 1F:
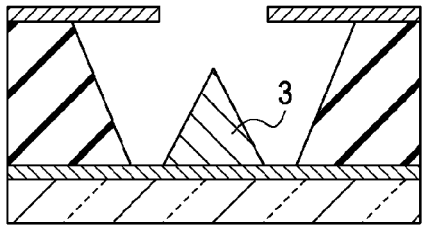
Figure 1G:
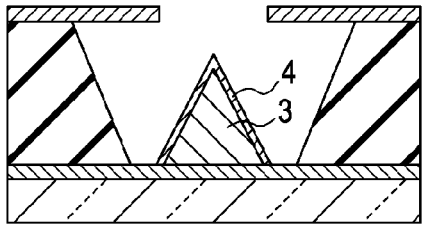
Figure 1H:
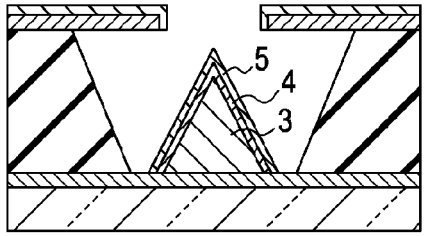
Figure 2:
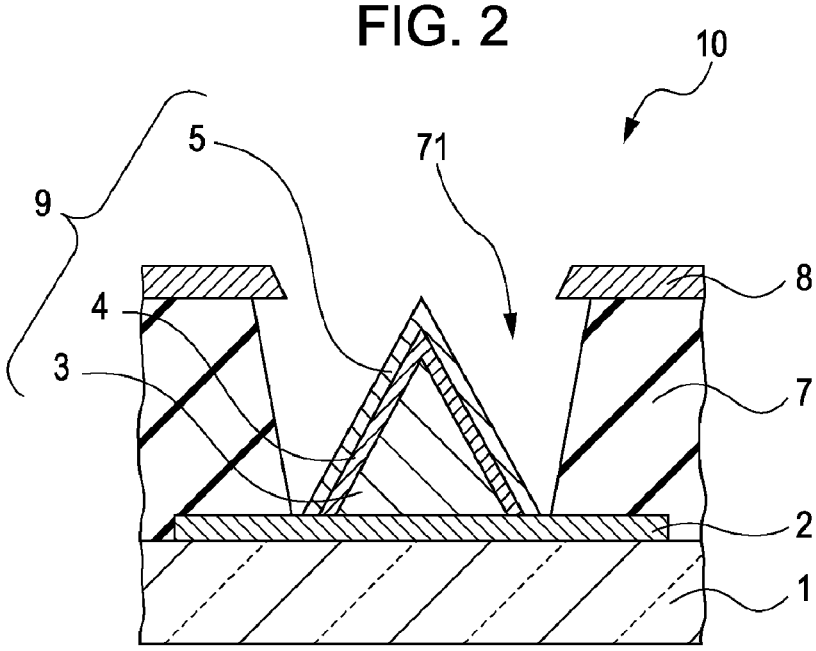
FIG. 2 is a schematic sectional view of an electron-emitting device fabricated by the method according to the first embodiment.

With reference to FIGS. 1 and 2, the structure 3 is conical in shape. The structure 3 may have any geometric shape capable of increasing an electric field generated on the electron-emitting member 9. Therefore, the surface of the structure 3 includes a bump or protruding portion. When the surface of the structure 3 includes such a bump or protruding portion, the surface of the low-work function layer 5 can include a bump or protruding portion because the low-work function layer 5, which is disposed above the structure 3 with the metal oxide layer 4 disposed therebetween, has a thickness less than that of the structure 3. In particular, the surface of the electron-emitting member 9 corresponds to the surface of the low-work function layer 5 as shown in FIGS. 1 and 2 or the surface of a lanthanum oxide layer 6 described below with reference to FIG. 3.

As shown in FIGS. 1 and 2, a gate electrode 8 is disposed on an insulating layer 7 for insulating the cathode electrode 2. The structure 3 is disposed in a first opening 71 extending through the insulating layer 7 and the gate electrode 8. The first opening 71 is not particularly limited in shape and may be circular or polygonal. The electron-emitting member 9 can be described to be placed in the first opening 71.

The electron-emitting device 10 is driven in such a manner that a predetermined voltage is applied between the cathode electrode 2 and the gate electrode 8 such that the potential of the cathode electrode 2 is lower than the potential of the gate electrode 8. The voltage applied therebetween depends on the distance between the electron-emitting member 9 and the gate electrode 8, the shape of the electron-emitting member 9 (particularly the shape of the structure 3), and the like and is 20 to 100 V. When such a voltage is applied between the cathode electrode 2 and the gate electrode 8, electrons are field-emitted from the low-work function layer 5, which is a surface portion of the electron-emitting member 9. The following device is referred to as a field emission-type electron-emitting device: an electron-emitting device in which a strong electric field is generated between an electron-emitting member and a gate electrode by applying a voltage between a cathode electrode and the gate electrode and therefore electrons are field-emitted from the surface of the electron-emitting member.

The method, which is used to fabricate the electron-emitting device 10, is further described below in detail. In this embodiment, the metal oxide layer 4 is formed on the structure 3 using an oxide of the metal contained in the structure 3 and the low-work function layer 5 may be then provided on the metal oxide layer 4. The structure 3, the metal oxide layer 4, and the low-work function layer 5 may be separately or continuously formed. Since the electron-emitting device 10 is fabricated by the method, the electron-emitting device 10 is useful in obtaining a good emission current and has good reproducibility in electron-emitting properties. Differences in electron-emitting properties between electron-emitting devices each fabricated by the method are small even if a large number of the electron-emitting devices are formed on a large-area substrate.

Some of steps below may be omitted or several steps may be combined into one.

Step 1

The following electrode and layers are formed on the substrate 1 in this order as shown in FIG. 1A: the cathode electrode 2, an insulating material layer 70, and a conductive material layer 80 for forming the gate electrode 8. The substrate 1 is made of glass and therefore is insulating. Alternatively, a laminate including the cathode electrode 2, insulating material layer 70, and conductive material layer 80 arranged in that order may be provided on the substrate 1. A material for forming the insulating material layer 70 is, for example, $SiO_2$. The thickness of the insulating material layer 70 is determined in consideration of a voltage for driving the electron-emitting device 10 and the like and may be, for example, 1 μm. The cathode electrode 2 and the conductive material layer 80 may be made of the same material or different materials. In this embodiment, the cathode electrode 2 is disposed between of the structure 3 and the substrate 1. The position of the cathode electrode 2 is not particularly limited if electrons can be supplied to the structure 3. For example, the cathode electrode 2 may be placed beside the structure 3. The cathode electrode 2 and the conductive material layer 80 may be made of a conductive material. Examples of the conductive material include metals such as Be, Mg, Ti, Zr, Hf, V, Nb, Ta, Mo, W, Al, Cu, Ni, Cr, Au, Pt, and Pd; alloys of these metals; carbides of these metals; borides of these metals; nitrides of these metals; and semiconductors such as Si and Ge.

Step 2

A second opening 81 with a predetermined shape are formed in the conductive material layer 80 by etching such as ion etching, whereby the gate electrode 8 is formed as shown in FIG. 1B. The second opening 81 may have, for example, a circular shape with a diameter of 1 μm. The shape of the second opening 81 is not particularly limited and may be circular or polygonal. The size of the second opening 81 is determined in consideration of a voltage (for example, 20 to 100 V) for driving the electron-emitting device 10.

Step 3

The insulating material layer 70 is etched by ion etching using the gate electrode 8 as a mask, whereby the first opening 71 is formed so as to extend through the insulating material layer 70. In this step, the insulating layer 7 is formed as shown in FIG. 1C. The insulating material layer 70 may be wet-etched or dry-etched.

Step 4

A sacrificial layer 82 is formed on the gate electrode 8 as shown in FIG. 1D. A material for forming the sacrificial layer 82 is not particularly limited and is different from materials for forming the cathode electrode 2, the gate electrode 8, or the structure 3.

Step 5

A material for forming the structure 3 is deposited in the first opening 71, whereby the structure 3 is formed as shown in FIG. 1E. The structure 3 is made of a material containing a metal or a material with a high melting point. The material for forming the structure 3 contains 70 atomic percent or more and 90 atomic percent or more of a metal element, which is a principal component of this material. In view of reproducibility and uniformity, the structure 3 may be made of a single high-melting point metal. Examples of the high-melting point metal include molybdenum and tungsten.

The structure 3 is herein illustrated to be conical. The structure 3 may have any geometric shape capable of increasing an electric field generated at the tip of the electron-emitting member 9. The structure 3 may have, for example, a triangular or quadrangular pyramid shape. Alternatively, the structure 3 may have a bar shape, an acicular shape, or a ridge shape (tabular shape) as well as carbon fibers. The structure 3 may include the bump or protruding portion. The bump or protruding portion protrudes from the substrate 1 toward, for example, the gate electrode 8 or the anode electrode. In the case of providing a resistor for limiting an emission current in the electron-emitting device 10, the resistor may be provided between the cathode electrode 2 and the structure 3 or provided in the cathode electrode 2. For the purpose of providing a better understanding, the cathode electrode 2 and the structure 3 are herein illustrated as different members. The cathode electrode 2 and the structure 3 may be made of the same material such that the cathode electrode 2 and the structure 3 form a single continuous member. In this case, the cathode electrode 2 and the structure 3 may be made of such a high-melting point metal as molybdenum or tungsten.

Step 6

The sacrificial layer 82 is selectively removed, whereby a layer 30 which is disposed on the sacrificial layer 82 and which is made of the same material as that for forming the structure 3 is also removed as shown in FIG. 1F.

The above steps can be performed by known techniques such as those proposed by Spindt et al.

Step 7

The metal oxide layer 4 is formed on the structure 3 as shown in FIG. 1G. The metal oxide layer 4 is made of an oxide of a metal contained in the structure 3. In particular, the metal oxide layer 4 is made of an oxide of a metal element most contained in the structure 3, that is, an oxide of a principal component of the structure 3. Therefore, the metal oxide layer 4 contains the same metal element as that contained in the structure 3. This allows the metal oxide layer 4 to be strongly bonded to the structure 3 and therefore allows the stable operation of the electron-emitting device 10. Furthermore, this allows the non-uniformity in shape of the structure 3 to be prevented from affecting differences in electron-emitting properties of the electron-emitting device 10. In order to prevent operation voltages from being increased and in order to supply electrons from the structure 3 to the low-work function layer 5, the metal oxide layer 4 used is conductive. When the structure 3 is made of molybdenum, the metal oxide layer 4 used is made of an oxide of molybdenum. Molybdenum dioxide ($MoO_2$) is considerably lower in resistivity (specific resistance) than molybdenum trioxide ($MoO_3$) and is a conductive oxide; hence, the metal oxide layer 4 used may be made of molybdenum dioxide.

When the structure 3 is made of tungsten, the metal oxide layer 4 used may be made of an oxide of tungsten. Tungsten dioxide ($WO_2$) is considerably lower in resistivity (specific resistance) than tungsten trioxide ($WO_3$) and is a conductive oxide; hence, the metal oxide layer 4 used may be made of tungsten dioxide.

The thickness of the metal oxide layer 4 depends on the resistivity thereof and is practically 3 to 20 nm. When the thickness thereof is less than 3 nm, practical benefits may not be achieved. When the thickness thereof is greater than 20 nm, the metal oxide layer 4 acts as a non-negligible resistive component; hence, an operation voltage is increased and electrons are prevented from being supplied from the structure 3 to the low-work function layer 5 through the metal oxide layer 4.

A process for forming the metal oxide layer 4 is not particularly limited. The metal oxide layer 4 can be formed by, for example, a common deposition process such as a sputtering process, a process in which the structure 3 is heated at high temperature in a controlled oxygen atmosphere, an extreme ultraviolet (EUV) irradiation process, or a similar process. When the metal oxide layer 4 is made of $MoO_2$, a Mo layer is formed by a sputtering process or a similar process and then irradiated with, for example, excimer ultraviolet (EUV) rays, whereby the Mo layer can be converted into the metal oxide layer 4.

Since the metal oxide layer 4 is formed on the structure 3 in advance of the formation of the low-work function layer 5, influences caused by the non-uniformity in shape of the structure 3 can be reduced. With reference to FIG. 1G, the metal oxide layer 4 extends over the structure 3. However, the metal oxide layer 4 need not extend over the structure 3. In the case of forming a large number of structures 3 on the substrate 1, metal oxide layers 4 are formed on all the structures 3 under substantially the same conditions in this step. This is effective in reducing a difference in shape between the structures 3.

Step 8

The low-work function layer 5, which is made of the material with a work function less than that of the metal contained in the structure 3, is provided on the metal oxide layer 4 as shown in FIG. 1H. Since the low-work function layer 5 is disposed on the metal oxide layer 4, a component contained in the structure 3, particularly the metal contained therein, can be prevented from being diffused into the metal oxide layer 4. This allows properties of the low-work function layer 5 to be stable.

The low-work function layer 5 can be formed by a common vacuum deposition process such as a vapor deposition process or a sputtering process. In one embodiment, the low-work function layer 5 has a thickness of about 20 nm or less and more about 10 nm or less for practical use.

With reference to FIG. 1H, the low-work function layer 5 extends over the metal oxide layer 4. However, the low-work function layer 5 need not extend over the metal oxide layer 4.

The material for forming the low-work function layer 5 has a work function less than that of the structure 3. The material for forming the low-work function layer 5 may have a work function less than that of the metal, which is a principal component, contained in the structure 3. A principal component of the structure 3 is defined as a metal component with the highest atomic concentration and is, for example, molybdenum or tungsten as described above. Molybdenum and tungsten have a work function of greater than 4.0 eV. Therefore, the material for forming the low-work function layer 5 has a work function of 4.0 eV or less and even 3.0 eV or less.

The work function of the material for forming the low-work function layer 5 can be determined by photoelectron spectroscopy such as vacuum ultraviolet photoelectron spectroscopy (VUPS), the Kelvin technique, a technique in which a field emission current is measured in a vacuum and the relationship between an electric field and a current is derived, or a similar technique. These techniques may be used in combination to determine the work function thereof.

In particular, an about 20-nm thick film (metal film) of a material (for example, tungsten) with a known work function is provided on the tip (bump portion) of a sharp-pointed conductive probe (for example, a tungsten probe). Electron-emitting properties of the probe are measured in such a manner that an electric field is applied to the probe in a vacuum. The field enhancement factor due to the shape of the bump portion, which is the tip of the probe, is determined from the electron-emitting properties thereof in advance. A film of the material for forming the low-work function layer 5 is provided on the metal film and then determined for work function by calculation.

Examples of the material for forming the low-work function layer 5 include metals such as Cs; metal compounds; and rare-earth metal oxides such as $La_2O_3$ (a work function of about 2.5 eV), $CeO_2$ (a work function of about 3.0 eV), and $Pr_2O_3$ (a work function of about 2.6 eV).

Other examples of the material for forming the low-work function layer 5 include rare-earth metal borides such as $CeO_6$ (a work function of about 2.6 eV) and metal oxides such as $Y_2O_3$, $ZrO_2$, and $ThO_2$. In particular, a boride of lanthanum (lanthanum boride) may be used to form the low-work function layer 5. The lanthanum boride used may be lanthanum hexaboride ($LaB_6$). Lanthanum hexaboride is a compound having a stoichiometric composition with a La to B ratio of 1:6 and has a simple cubic lattice. Examples of the lanthanum boride include non-stoichiometric lanthanum compounds and lanthanum compounds with various lattice constants.

In one embodiment, the low-work function layer 5 is made of polycrystalline lanthanum boride rather than single-crystalline lanthanum boride. Polycrystalline lanthanum boride exhibits metallic conductivity and is electrically conductive. In general, polycrystalline layers can be more readily formed than single-crystalline layers. The polycrystalline layers are used because the polycrystalline layers can be formed so as to follow fine complicated surface irregularities of the structure 3 and can reduce internal stresses. The single-crystalline layers are lower in work function than the polycrystalline layers; however, the control of the thickness and/or grain size of the polycrystalline layers allows the polycrystalline layers to have a work function of 3.0 eV, which is close to the work function of the single-crystalline layers.

Figure 4:
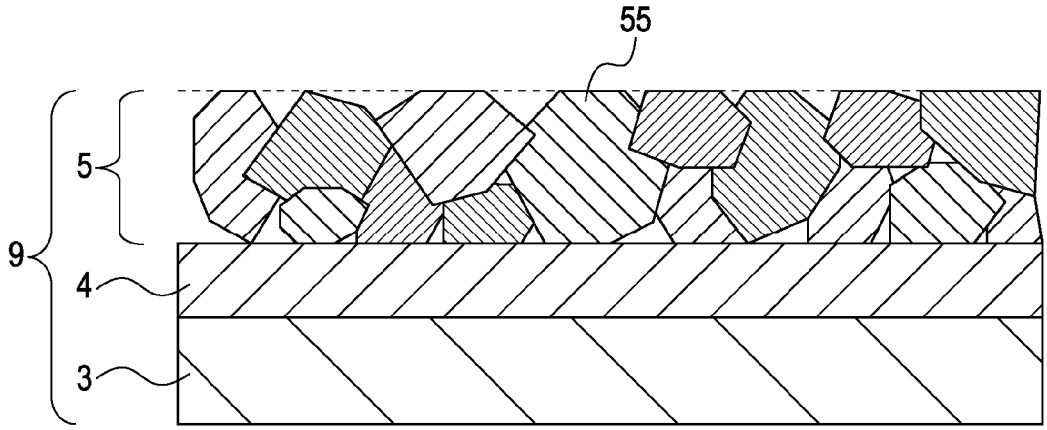
FIG. 4 is a schematic sectional view of a polycrystalline layer of lanthanum boride.

With reference to FIG. 4, the polycrystalline layer 5 of lanthanum boride contains a large number of crystallites 55 and therefore has polycrystalline properties. The term "crystallite" as used herein means the largest aggregate that can be regarded as a single crystal. The term "polycrystalline layer" as used herein means a layer in which crystallites or clusters (groups) of crystallites are bonded to or are in contact with each other and which therefore exhibits metallic conductivity. Cavities (gaps or spaces) may be present between the crystallites or the crystallite clusters (groups). FIG. 4 is a schematic view showing that a lanthanum boride layer is the polycrystalline layer 5 and is not intended to limit properties of the metal oxide layer 4 or structure 3.

Therefore, any polycrystalline layer used herein is different from a so-called fine-grain layer containing clusters of fine grains. The term "grain" means matter containing a plurality of crystallites, amorphous particulate matter, or particulate-looking matter and uses of this term are not sometimes clear.

The crystallites 55, which are contained in the polycrystalline layer 5 of lanthanum boride, have a size of 2.5 nm or more. The polycrystalline layer 5 has a thickness of 100 nm or less. Therefore, the upper limit of the size of the crystallites 55 is necessarily 100 nm. Since the polycrystalline layer 5 has a crystallite size of 2.5 nm or more, the emission current of the polycrystalline layer 5 is more stable than those of polycrystalline layers with a crystallite size of 2.5 nm or less (fluctuation is reduced). When the crystallite size of the polycrystalline layer 5 exceeds 100 nm, the thickness of the polycrystalline layer 5 also exceeds 100 nm and therefore the polycrystalline layer is stripped off; hence, other electron-emitting devices including low-work function layers have unstable properties. When the crystallite size of the polycrystalline layer 5 is less than 2.5 nm, the work function thereof is greater than 3.0 eV. This is probably because the composition ratio of La to B significantly deviates from 6.0 and therefore an unstable state that cannot maintain crystallinity is caused. The polycrystalline layer 5 has a thickness of approximately 20 nm or less because differences between electron-emitting properties of the electron-emitting device 10 are small.

The size of the crystallites 55 can be determined typically by X-ray diffractometry. In particular, the crystallite size can be calculated from the profile of the diffraction pattern by a technique called the Scherrer technique. In addition to determining the crystallite size, X-ray diffractometry can be used to confirm that the polycrystalline layer 5 is made of stoichiometric polycrystalline lanthanum boride and also used to study the orientation of the polycrystalline layer 5. The observation of the polycrystalline layer 5 by cross-sectional transmission electron microscopy (cross-sectional TEM) confirms that a plurality of lattice fringes are arranged substantially in parallel to regions corresponding to the crystallites 55. Thus, the crystallite size (crystallite diameter) can be determined as follows: the two lattice fringes that are most apart from each other are selected and the length of the longest one of segments connecting ends of one of the two lattice fringes to ends of the other one is recognized as the crystallite size. If a plurality of crystallites are confirmed to be present in a region observed by cross-sectional TEM, the average of the sizes of these crystallites can be used as the crystallite size of a polycrystalline lanthanum boride layer.

Although the metal oxide layer 4 used is conductive, some of metal oxides are insulating. In one embodiment, when the low-work function layer 5 is made of lanthanum boride, the metal oxide layer 4 used contains La. "La" is the chemical symbol for lanthanum. If a metal oxide containing no La is insulating, the resistivity of the metal oxide can be reduced by adding La to the metal oxide. The metal oxide layer 4 can be formed from the metal oxide so as to be conductive.

For example, La can combine with oxygen in the metal oxide contained in the metal oxide layer 4 to form stable lanthanum oxides. Dilanthanum trioxide ($La_2O_3$), which is an oxide of lanthanum, has lower resistivity as compared to common metal oxides and is a stable oxide. Therefore, electrons can be sustainably supplied from the structure 3 to the lanthanum boride layer 5; hence, stable electron-emitting properties can be achieved.

The composition of a La-free metal oxide is varied by adding La to the La-free metal oxide. This may increase the conductivity of the La-free metal oxide.

In the case of forming the structure 3 from, for example, molybdenum, oxides of molybdenum therein include $MoO_3$, which is insulating. The metal oxide layer 4 is formed from molybdenum and La is added thereto. The metal oxide layer 4 contains $La_2O_3$, which is an oxide of La, and $MoO_2$ and therefore have higher conductivity as compared to a metal oxide layer made of $MoO_3$.

In the case of forming the structure 3 from tungsten, oxides of tungsten therein include $WO_3$, which is insulating. The metal oxide layer 4 is formed from tungsten and La is added thereto. The metal oxide layer 4 contains $La_2O_3$, which is an oxide of La, and $WO_2$ and therefore have higher conductivity as compared to a metal oxide layer made of $WO_3$.

The content of La in the metal oxide layer 4 may be determined depending on electron-emitting properties and is five to 30 atomic percent for practical use. A principal component of the metal oxide layer 4 is not La but a metal element contained in the structure 3 or an oxide of the metal element therein. Therefore, the molybdenum or tungsten and oxygen content of the metal oxide layer 4 is 70 to 95 atomic percent.

Examples of a process for forming the metal oxide layer 4 such that the metal oxide layer 4 contains La include a process for doping a La-free oxide layer with La and a sputtering process using a target containing a material for forming an oxide and La.

The electron-emitting device 10 is basically fabricated through Steps 1 to 8 as shown in FIG. 2.

Figure 3:
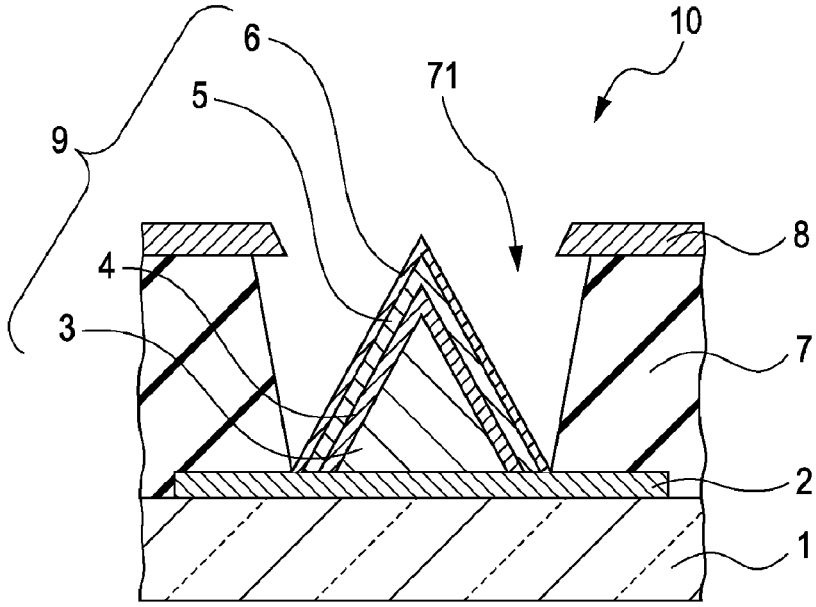
FIG. 3 is a schematic sectional view of an electron-emitting device fabricated by a method according to another embodiment.

When the low-work function layer 5 is a polycrystalline layer of lanthanum boride, Step 9 below may be performed such that the polycrystalline layer of lanthanum boride is coated with the lanthanum oxide layer 6. In Step 9, the lanthanum oxide layer 6 is deposited on the polycrystalline layer 5 of lanthanum boride as shown in FIG. 3.

Step 9

When the low-work function layer 5 is such a polycrystalline layer of lanthanum boride, the polycrystalline layer of lanthanum boride is coated with lanthanum oxide ($LaO_x$).

The lanthanum oxide layer 6 is made of lanthanum oxide ($LaO_x$) and may particularly be made of dilanthanum trioxide ($La_2O_3$). The lanthanum oxide layer 6 (for example, a $La_2O_3$ layer) is more stable against an atmosphere (particularly an oxygen atmosphere) than the lanthanum boride layer 5 (for example, a $LaB_6$ layer). $La_2O_3$ is a material that has a low work function (about 2.6 eV) close to the work function (about 2.5 eV) of $LaB_6$. Therefore, the presence of the lanthanum oxide layer 6 on the lanthanum boride layer 5 is effective in achieving stable electron-emitting properties. Lanthanum boride and lanthanum oxide are stably bonded to each other.

In other embodiment, the lanthanum oxide layer 6 has a thickness of approximately 1 to 10 nm for practical use. When the thickness thereof is approximately less than 1 nm, any benefit of lanthanum oxide is hardly obtained. When the thickness thereof is greater than 10 nm, the number of electrons emitted from the lanthanum oxide layer 6 is small.

A process for forming the lanthanum oxide layer 6 on the lanthanum boride layer 5 is not particularly limited. For example, the lanthanum boride layer 5 may be heated in a controlled oxygen atmosphere such that a surface portion of the lanthanum boride layer 5 is converted into the lanthanum oxide layer 6. Alternatively, the lanthanum oxide layer 6 may be formed on the lanthanum boride layer 5 by a common deposition process such as a vapor deposition process or a sputtering process.

In the electron-emitting device 10 shown in FIG. 3, electrons are emitted from the lanthanum boride layer 5 or the lanthanum oxide layer 6 or emitted from both of the lanthanum boride layer 5 and the lanthanum oxide layer 6. The structure 3, the metal oxide layer 4, and the lanthanum boride layer 5 can be collectively referred to as the electron-emitting member 9. With reference to FIG. 3, the lanthanum oxide layer 6 extends over the lanthanum boride layer 5. The lanthanum oxide layer 6 need not extend over the lanthanum boride layer 5. In this case, a surface portion of the lanthanum boride layer 5 and a surface of the lanthanum oxide layer 6 form a surface of the electron-emitting member 9.

Figure 5A:
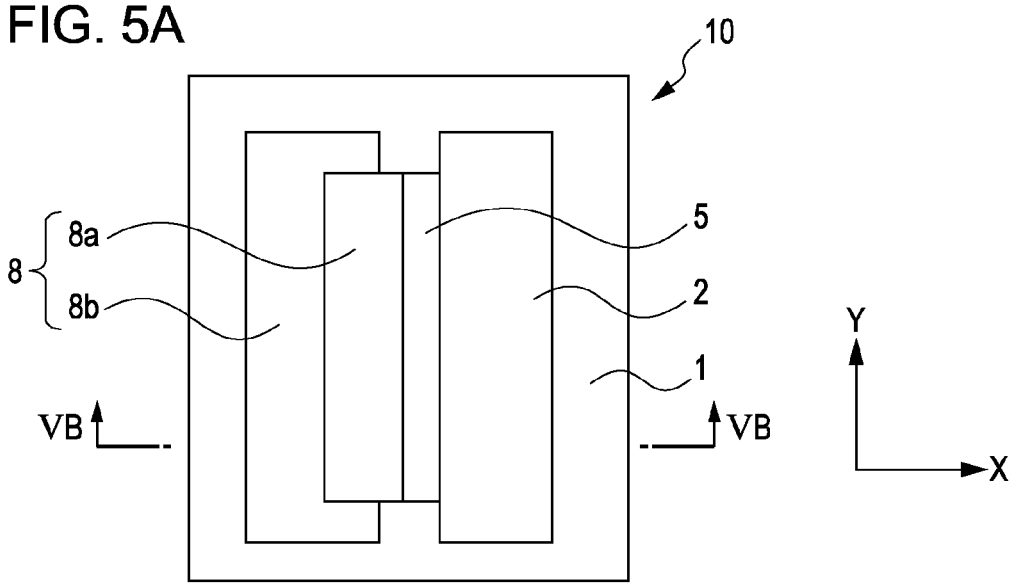
FIG. 5A is a plan view of an electron-emitting device fabricated by a method according to a second embodiment of the present invention.
Figure 5B:
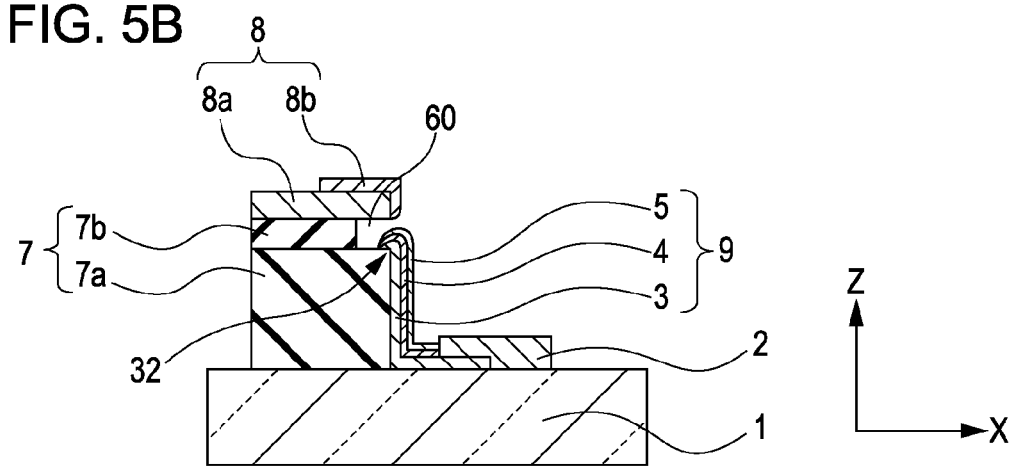
FIG. 5B is a schematic sectional view of the electron-emitting device taken along the line VB-VB of FIG. 5A
Figure 5C:
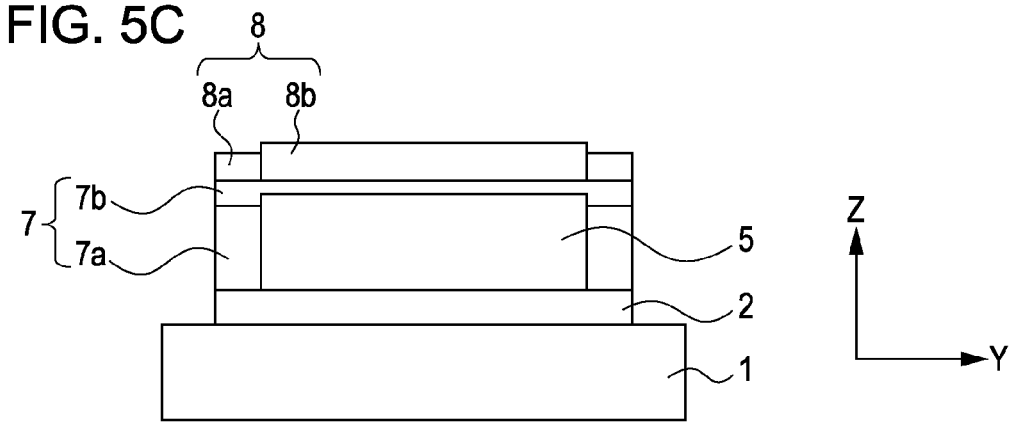
FIG. 5C is a schematic plan view of the electron-emitting device 10 viewed in an X-direction in FIG. 5B.

A method of fabricating an electron-emitting device 10 according to a second embodiment of the present invention will now be described with reference to FIGS. 5A, 5B, and 5C. FIG. 5A is a schematic plan view of the electron-emitting device 10 viewed in a Z-direction. FIG. 5B is a schematic sectional view of the electron-emitting device 10 taken along the line VB-VB of FIG. 5A. FIG. 5C is a schematic plan view of the electron-emitting device 10 viewed in an X-direction in FIG. 5B.

The electron-emitting device 10 includes a gate electrode 8 disposed above a substrate 1 and an insulating layer 7 disposed therebetween. The insulating layer 7 includes a first insulating sub-layer 7*a* and a second insulating sub-layer 7*b* and may have a single-layer or multilayer structure. The gate electrode 8 includes a first gate electrode portion 8*a* and a second gate electrode portion 8*b* and may have a single-layer or multilayer structure. The electron-emitting device 10 includes a cathode electrode 2 disposed on the substrate 1 and a structure 3 connected to the cathode electrode 2. The structure 3 contains a metal and extends along a side surface of the first insulating sub-layer 7*a* in a direction away from the substrate 1. The electron-emitting device 10 further includes a metal oxide layer 4 disposed on the structure 3 and a lanthanum boride layer 5 disposed on the metal oxide layer 4. In other words, the metal oxide layer 4 is disposed between the structure 3 and the lanthanum boride layer 5. The structure 3, the metal oxide layer 4, and the lanthanum boride layer 5 form an electron-emitting member 9.

A side surface of the insulating layer 7 that carries the structure 3 is perpendicular to the upper surface of the substrate 1 as shown in FIG. 5B and may be inclined with respect to the upper surface of the substrate 1. The upper surface of the first insulating sub-layer 7*a* is parallel or substantially parallel to the upper surface of the substrate 1 and is connected to this side surface through a corner portion 32. The second insulating sub-layer 7*b* is smaller in width than the first insulating sub-layer 7*a* when viewed in an X-direction. A recessed portion 60 is disposed between the first insulating sub-layer 7*a* and the first gate electrode portion 8*a*.

With reference to FIG. 5B, the structure 3 is a member protruding from the substrate 1 in a +Z-direction and includes a bump portion. The +Z-direction is herein defined as a direction away from the substrate 1, that is, a direction toward the gate electrode 8 or an anode electrode below. The structure 3 includes an end portion which is on the gate electrode 8 side thereof and which extends in the recessed portion 60. That is, the gate electrode 8-side end portion of the structure 3 extends from an upper surface portion of the first insulating sub-layer 7*a* that is located in the recessed portion 60 to a side surface portion of the first insulating sub-layer 7*a*. Since the upper surface and this side surface of the first insulating sub-layer 7*a* are connected to each other through the corner portion 32, the bump portion of the structure 3 has a geometric shape capable of increasing an electric field generated on the electron-emitting member 9.

Since the gate electrode 8-side end portion of the structure 3 extends in the recessed portion 60, there are benefits below. (1) The contact area between the structure 3 and the first insulating sub-layer 7*a* is large and therefore the mechanical adhesion (adhesion strength) therebetween is high. (2) The heat generated from the electron-emitting member 9 can be efficiently dissipated because of the large contact area between the structure 3 and the first insulating sub-layer 7*a*. (3) The intensity of a triple point electric field generated at an insulator-vacuum-conductor interface in the recessed portion 60 is reduced and therefore a discharge phenomenon can be prevented from being caused by an extraordinary electric field.

In this embodiment, the structure 3 is covered with a low-work function layer 5 with the metal oxide layer 4 disposed therebetween. Only the bump portion of the structure 3 may be covered with the low-work function layer 5 with the metal oxide layer 4 disposed therebetween.

In one embodiment the low-work function layer 5 is a polycrystalline layer 5 of lanthanum boride as described above with reference to FIG. 4. When the low-work function layer 5 is the polycrystalline layer 5 of lanthanum boride, the metal oxide layer 4 used contains lanthanum. The electron-emitting member 9 may include a lanthanum oxide layer (not shown) disposed on the low-work function layer 5 as described above with reference to FIG. 3.

With reference to FIGS. 5A to 5C, the first gate electrode portion 8*a* is partly covered with the second gate electrode portion 8*b*. The second gate electrode portion 8*b* and the structure 3 are made of the same conductive material. The second gate electrode portion 8*b* may be omitted and may be presented to form a stable electric field. Therefore, the gate electrode 8 includes the first and second gate electrode portions 8*a* and 8*b* as shown in FIG. 5. The low-work function layer 5 may extend on the gate electrode 8. With reference to FIGS. 5A and 5C, the electron-emitting member 9 continuously extends in a Y-direction and has a ridge shape (tabular shape). The electron-emitting member 9 may include a plurality of portions arranged at predetermined intervals in the Y-direction.

An exemplary method of manufacturing the electron-emitting device 10 will now be described with reference to FIGS. 5A to 5C.

Step 1

Figure 9A:
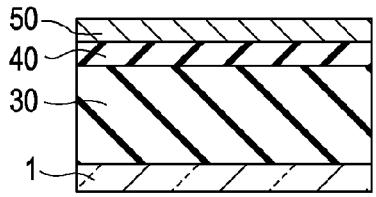
FIGS. 9A to 9G are schematic views illustrating steps of a method of fabricating an electron-emitting device according to a second embodiment of the present invention.

As shown in FIG. 9A, a first insulating film 30 for forming the first insulating sub-layer 7*a* is formed on the substrate 1, a second insulating film 40 for forming the second insulating sub-layer 7*b* is deposited on the upper surface of the first insulating film 30, and a conductive layer 50 for forming the first gate electrode portion 8*a* is then deposited on the upper surface of the second insulating film 40. A material for forming the second insulating film 40 is selected from materials different from a material for forming the first insulating film 30 such that a large amount of the second insulating film 40 is etched with an etching solution (etchant) used in Step 3 below.

Step 2

The conductive layer 50, the second insulating film 40, and the first insulating film 30 are etched (a first etching treatment).

Figure 9B:
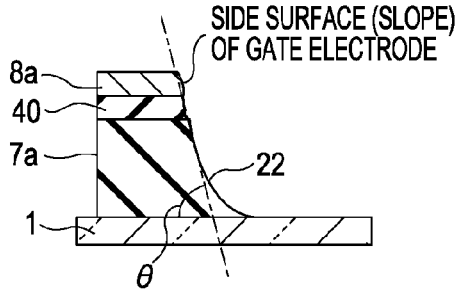

In the first etching treatment, after a resist pattern is formed on the conductive layer 50 by photolithography or the like, the conductive layer 50, the second insulating film 40 and the first insulating film 30 are etched. In Step 2, the first insulating sub-layer 7*a* and first gate electrode portion 8*a*, which are included in the electron-emitting device 10 shown in FIGS. 5A to 5C, are formed as shown in FIG. 9B. A side surface (slope) 22 of the first insulating sub-layer 7*a* that is formed in this step forms an angle (θ) of less than 90 degrees with the upper surface of the substrate 1 as shown in FIG. 9B. A side surface (slope) of the first gate electrode portion 8*a* and the upper surface of the first insulating sub-layer 7*a* (the upper surface of the substrate 1) make an angle less than the angle (θ) formed by the side surface (slope) 22 of the first insulating sub-layer 7*a* and the upper surface of the substrate 1.

Step 3

Figure 9C:
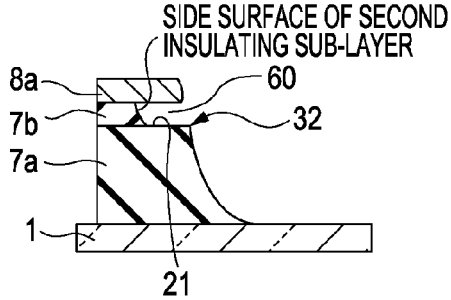

As shown in FIG. 9C, the second insulating film 40 is etched (a second etching treatment).

In Step 3, the second insulating sub-layer 7*b*, which is included in the electron-emitting device 10 shown in FIGS. 5A to 5C, are formed. The recessed portion 60 is defined by a portion of the upper surface of the first insulating sub-layer 7*a* and a side surface of the second insulating sub-layer 7*b*. In further detail, the recessed portion 60 is defined by a portion of the lower surface of the first gate electrode portion 8*a*, a portion of the upper surface of the first insulating sub-layer 7*a*, and a side surface of the second insulating sub-layer 7*b*. In Step 3, side surfaces of the second insulating film 40 are etched and therefore the upper surface of the first insulating sub-layer 7*a* is partly uncovered. A connection between an uncovered upper surface portion 21 of the first insulating sub-layer 7*a* and the side surface (slope) 22 of the first insulating sub-layer 7*a* is the corner portion 32.

Step 4

A first conductive film 60A made of the material for forming the structure 3 is deposited over the upper surface of the substrate 1, the side surface (slope) 22 of the first insulating sub-layer 7*a* that is on the cathode electrode 2 side, and the upper surface portion 21 of the first insulating sub-layer 7*a*.

The first conductive film 60A partly covers the corner portion 32 of the first insulating sub-layer 7*a* and extends over the side surface (slope) 22 of the first insulating sub-layer 7*a* and the upper surface portion 21 of the first insulating sub-layer 7*a*.

In one embodiment the first conductive film 60A is formed so as to have a first portion disposed on the corner portion 32 and upper surfaces of the first insulating sub-layer 7*a* and a second portion located on the slope 22 of the first insulating sub-layer 7*a*, the first portion being higher in density than the second portion. A second conductive film 60B made of the material for forming the second gate electrode portion 8*b* may be deposited on the first gate electrode portion 8*a* together with the first conductive film 60A. This allows the first and second conductive films 60A and 60B to be formed as shown in FIG. 9D.

Figure 9D:
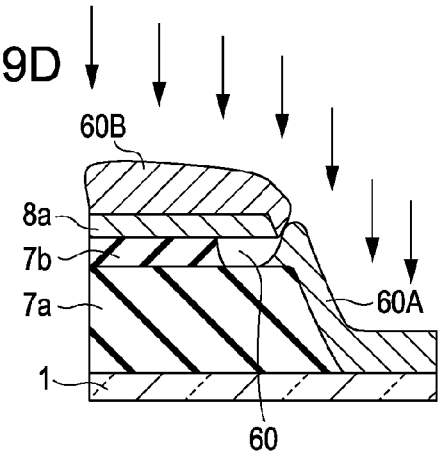

With reference to FIG. 9D, the first conductive film 60A is in contact with the second conductive film 60B. In Step 4, the first and second conductive films 60A and 60B may be formed so as not to be in contact with each other, that is, so as to be spaced from each other.

In order to precisely control the size (distance d) of a gap 18 below, the first and second conductive films 60A and 60B are formed so as to be in contact with each other as shown in FIG. 9D.

Step 5

The first and second conductive films 60A and 60B are etched (a third etching treatment).

The third etching treatment is a treatment primarily for etching the first and second conductive films 60A and 60B in the thickness direction thereof.

In Step 5, the gap 18 is formed between the first and second conductive films 60A and 60B, which have been formed in Step 4 so as to be in contact with each other. Furthermore, an end portion (bump) of the first conductive film 60A can be sharpened. Pieces of conductive materials used to form the first and second conductive films 60A and 60B can be removed from the recessed portion 60. These allow the structure 3 and the second gate electrode portion 8*b* to be formed as shown in FIGS. 9E and 9F.

In Step 5, before being etched, the first and second conductive films 60A and 60B may be subjected to oxidation so as to be surface-oxidized. In Step 5, oxidation and etching may be repeated.

Figure 9E:
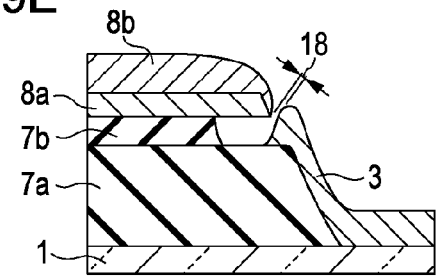
Figure 9F:
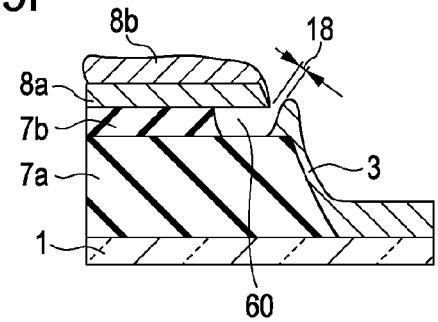

The combination of oxidation and etching allows the tips of the bump portion of the structure 3 to be sharpened with better control as shown in FIG. 9F as compared to simple etching (FIG. 9E). Furthermore, the gap 18 between the structure 3 and the second gate electrode portion 8*b* can be formed with high control. Therefore, the electron-emitting device 10 can be formed so as to have higher electron-emitting properties.

Step 5 is a step for etching the first and second conductive films 60A and 60B in the thickness direction thereof as described above. In Step 5, all uncovered surfaces of the first and second conductive films 60A and 60B are exposed to an etchant.

Step 6

Figure 9G:
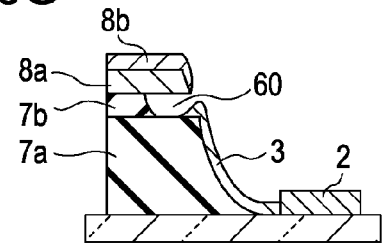
Figure 9G:
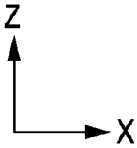

The cathode electrode 2, which are used to supply electrons to the structure 3, is formed as shown in FIG. 9G. This step may be performed before or after another step. The cathode electrode 2 need not be used and a conductive film (or the structure 3) may serve as the cathode electrode 2. In this case, Step 6 may be omitted.

Step 7

After Steps 5 and 6 are performed, the metal oxide layer 4 and the low-work function layer 5 are deposited on the structure 3 as shown in FIGS. 1G and 1H, whereby the electron-emitting device 10 is formed as shown in FIGS. 5A to 5C. The metal oxide layer 4 and the low-work function layer 5 can be formed by the above-mentioned processes.

The above steps are further described below in detail.

(About Step 1)

The first insulating film 30, which is used to form the first insulating sub-layer 7*a*, is made of a readily processable material such as silicon nitride (typically $Si_3N_4$) or silicon oxide (typically $SiO_2$). The first insulating film 30 can be formed by a common vacuum deposition process such as a sputtering process, a chemical vapor deposition (CVD) process, or a vacuum vapor deposition process. The first insulating film 30 may have a thickness of several nanometers to several tens of micrometers or may be ever several tens of nanometers several hundreds of nanometers.

The second insulating film 40, which is used to form the second insulating sub-layer 7*b*, is also made of a readily processable material such as silicon nitride (typically $Si_3N_4$) or silicon oxide (typically $SiO_2$). The second insulating film 40 can be formed by a common vacuum deposition process such as a sputtering process, a CVD process, or a vacuum vapor deposition process. The second insulating film 40 is thinner than the first insulating film 30 and has a thickness of several nanometers to several hundreds of nanometers or even several nanometers to several tens of nanometers.

After the first insulating film 30 and the second insulating film 40 are deposited on the substrate 1 in that order, the recessed portion 60 is to be formed in Step 3. Therefore, the first and second insulating films 30 and 40 are set such that the etching amount of the second insulating film 40 is greater than that of the first insulating film 30. The ratio of the etching amount of the first insulating film 30 to that of the second insulating film 40 may be ten or more or even 50 or more.

In one embodiment, in order to achieve the above ratio, the first insulating film 30 is made of silicon nitride and the second insulating film 40 is made of silicon oxide, phosphosilicate glass (PSG) with high phosphorus content, or borosilicate glass (BSG) with high boron content.

The conductive layer 50, which is used to form the gate electrode 8, is conductive and is one formed by a common vacuum deposition process such as a vapor deposition process or a sputtering process.

A material for forming the conductive layer 50, which is particularly used to form the first gate electrode portion 8*a*, has electrical conductivity, high heat conductivity, and a high melting point. Examples of this material include metals such as Be, Mg, Ti, Zr, Hf, V, Nb, Ta, Mo, W, Al, Cu, Ni, Cr, Au, Pt, and Pd; alloys of these metals; carbides of these metals; borides of these metals; nitrides of these metals; and semiconductors such as Si and Ge.

The thickness of the conductive layer 50, which is used to form the first gate electrode portion 8*a*, is set to a range from several nanometers to several hundreds of nanometers and more or even several tens of nanometers to several hundreds of nanometers.

The conductive layer 50 may be thicker than the cathode electrode 2 and therefore has a resistance less than that of the cathode electrode 2.

(About Step 2)

In the first etching treatment, reactive ion etching (RIE) is used because a material can be precisely etched in such a manner that a plasma generated from an etching gas is applied to this material.

Gas used for RIE is selected from fluorine-containing gases such as $CF_4$, $CHF_3$, and $SF_6$ when a member to be etched is made of a material producing a fluoride or selected from chlorine-containing gases such as $Cl_2$ and $BCl_3$ when the member to be etched is made of a material, such as Si or Al, producing a chloride. In order to adjust the selectivity of the member to be etched to a resist, in order to maintain the flatness of an etching surface, or in order to increase the etching rate of the member to be etched, at least one of hydrogen, oxygen, and argon is added to an etching gas.

In Step 2, the first insulating sub-layer 7*a* and first gate electrode portion 8*a*, which are included in the electron-emitting device 10, are formed so as to have the same or substantially the same as the final shapes thereof. However, this does not mean that the first insulating sub-layer 7*a* and the first gate electrode portion 8*a* are not etched at all in an etching treatment subsequent to Step 2 or another step.

The angle θ, shown in FIG. 9B, formed by the upper surface of the substrate 1 and the side surface (slope) 22 of the first insulating sub-layer 7*a* can be adjusted to a value by controlling conditions such as the species and pressure of gas used. The angle θ may be less than 90 degrees. This is for the purpose of controlling the nature (density) of the first conductive film 60A, which is formed over the side surface (slope) 22 of the first insulating sub-layer 7*a*.

Since the angle θ is set to be less than 90 degrees, the cathode electrode 2-side side surface of the first gate electrode portion 8*a* are spaced back from the cathode electrode 2-side side surface of the first insulating sub-layer 7*a*. The angle formed by a side surface (slope) of the first gate electrode portion 8*a* and the upper surface of the first insulating sub-layer 7*a* (or the upper surface of the substrate 1) is less than the angle θ formed by the upper surface of the substrate 1 and the side surface (slope) 22 of the first insulating sub-layer 7*a*. The angle formed by the upper surface 21 of the first insulating sub-layer 7*a* and the side surface (slope) 22 of the first insulating sub-layer 7*a* can be given by the formula 180°-θ.

The angle θ can be defined as the angle formed by the upper surface of the substrate 1 and a line which is tangential to one of the side surface 22 of the first insulating sub-layer 7*a* and which extends through the corner portion 32 toward the substrate 1 as shown in FIG. 9B.

Since the first insulating sub-layer 7*a* is formed on the upper surface of the substrate 1 by the common deposition process, the upper surface 21 of the first insulating sub-layer 7*a* is parallel to or substantially parallel to the upper surface (a horizontal direction 12) of the substrate 1. That is, the upper surface 21 of the first insulating sub-layer 7*a* may be completely parallel to the upper surface of the substrate 1 and may be slightly inclined with respect to the upper surface of the substrate 1 depending on deposition conditions and the like. This covers a situation in which the upper surface 21 of the first insulating sub-layer 7*a* is parallel to or substantially parallel to the upper surface of the substrate 1.

(About Step 3)

In Step 3, the etching solution is selected such that the amount of the first insulating sub-layer 7*a* etched by the etching solution is sufficiently less than the amount of the second insulating film 40 etched by the etching solution.

When the second insulating film 40 is made of silicon oxide and the first insulating sub-layer 7*a*, which is formed from the first insulating film 30, is made of silicon nitride, the etching solution used in the second etching treatment may be so-called buffered hydrofluoric (BHF) acid. Buffered hydrofluoric (BHF) acid is a mixture of ammonium fluoride and hydrofluoric acid. When the second insulating film 40 is made of silicon nitride and the first insulating sub-layer 7*a*, which are formed from the first insulating film 30, is made of silicon oxide, an etchant used may be a hot phosphoric acid etching solution.

In Step 3, the second insulating sub-layer 7*b*, which is included in the electron-emitting device 10, is formed so as to have the same or substantially the same as the final shape thereof. However, this does not mean that the second insulating sub-layer 7*b* are not etched at all in an etching treatment subsequent to Step 3 or another step.

The depth (depthwise distance) of the recessed portion 60 is deeply involved with the current leaking from the electron-emitting device 10. An increase in the depth of the recessed portion 60 reduces the leakage current. However, an excessive increase in the depth of the recessed portion 60 causes a situation such as the distortion of the first gate electrode portion 8*a*. Therefore, the depth of the recessed portion 60 is set to be 30 to 200 nm for practical use. The depth of the recessed portion 60 can be translated into the distance from the side surface 22 (or corner portion 32) of the first insulating sub-layer 7*a* to the side surface of the second insulating sub-layer 7*b*.

(About Step 4)

In Step 4, the first and second conductive films 60A and 60B are formed by a vacuum deposition process such as a vapor deposition process or a sputtering process.

The first conductive film 60A is formed so as to have the first portion, which is disposed on the corner portion 32 and upper surface of the first insulating sub-layer 7*a*, and the second portion, which is located on the slope 22 of the first insulating sub-layer 7*a*, the first portion being higher in density than the second portion. This allows the first portion of the first conductive film 60A that is disposed on the upper surface 21 (corner portion 32) of the first insulating sub-layer 7*a* to have a bump shape (a bump portion). That is, the first conductive film 60A can be formed so as to have the sharp bump portion disposed on the upper surface 21 (corner portion 32) of the first insulating sub-layer 7*a*. A portion of the first conductive film 60A that is disposed on the slope 22 of the first insulating sub-layer 7*a* is lower in density than the bump portion of the first conductive film 60A. Therefore, the bump portion can be sharpened in the third etching treatment in Step 5.

In order to achieve the above configuration, the first conductive film 60A is formed by a directional deposition process such as a directional sputtering process or a directional vapor deposition process. The use of the directional deposition process is effective in controlling the angle of each of the materials (deposition materials), used to form the first and second conductive films 60A and 60B, incident on the upper surface and side surface of the first insulating sub-layer 7*a* and the upper surface and side surface of the first gate electrode portion 8*a*.

In the case of using the directional sputtering process, after the angle between the substrate 1 and a target is adjusted, a shielding plate is provided between the substrate 1 and the target and/or the distance between the substrate 1 and the target is adjusted close to the mean free path of sputtered particles. A so-called collimation sputtering process in which a collimator is used to render sputtered particles directional is an example of the directional sputtering process. Sputtered particles (sputtered atoms or molecules) with a limited incident angle are allowed to be incident on surfaces (the slope of the first insulating sub-layer 7*a* or the like) to be coated.

The incident angle of sputtered particles (deposition materials) with respect to the slope of the first insulating sub-layer 7*a* is less (shallower) than the incident angle of the sputtered particles (deposition materials) with respect to the upper surface (corner portion 32) of the first insulating sub-layer 7*a*. The incident angle of the sputtered particles with respect to the upper surface (corner portion 32) of the first insulating sub-layer 7*a* is set more close to 90 degrees than the incident angle of sputtered particles with respect to the slope of the first insulating sub-layer 7*a*. This allows the sputtered particles to be incident on the upper surface (corner portion 32) of the first insulating sub-layer 7*a* at an angle more close to 90 degrees as compared to the slope of the first insulating sub-layer 7*a*. Therefore, the first portion of the first conductive film 60A that is disposed on the upper surface 21 (corner portion 32) of the first insulating sub-layer 7*a* is allowed to have such a bump shape (a bump portion).

For a deposition process, the probability of the collision of a material (deposition material) vaporized from an evaporation source is low if deposition is performed at a degree of vacuum of about $10^{-4}$ to $10^{-2}$ Pa. Since the mean free path of particles of the vaporized material (deposition material) is about several hundreds of millimeters to several meters, the particles arrive at a substrate with the directions of the particles emerging from the evaporation source being maintained. Therefore, the deposition process is directional. Examples of a technique for vaporizing the evaporation source include resistive heating, high-frequency induction heating, and electron-beam heating. The use of electron-beam heating is effective because of the types of materials available and heated areas.

In Step 2, the angle θ is set to be less than 90 degrees; hence, the cathode electrode 2-side side surface of the first gate electrode portion 8*a* is spaced back from the cathode electrode 2-side side surface of the first insulating sub-layer 7*a* as described above. A better film is formed over the corner portion 32 by the directional deposition described in Step 4 as compared to films formed on these side surfaces (slopes). The term "better film" can be herein translated into "high-density film" or "film with high density".

A larger number of good films can be formed on the upper surface of the first insulating sub-layer 7*a* by reducing the angle θ formed by the first etching treatment in Step 2. That is, a larger number of good films can be formed on the upper surface of the first insulating sub-layer 7*a* in such a manner that the cathode electrode 2-side side surface of the first gate electrode portion 8*a* is more significantly spaced back from the cathode electrode 2-side side surface of the first insulating sub-layer 7*a*.

In Step 4, the first and second conductive films 60A and 60B may be formed so as not to be in contact with each other, that is, so as to be spaced from each other. In the case of not providing the second gate electrode portion 8*b* on the first gate electrode portion 8*a*, the first conductive film 60A is formed so as to be spaced from the first gate electrode portion 8*a*.

The gap 18, which has a distance d, is to be precisely formed between the first and second conductive films 60A and 60B. In the case of uniformly forming electron-emitting devices, it is important to reduce differences in size between spaces between the electron-emitting devices. In order to precisely control the size (distance d) of the gap 18, the first and second conductive films 60A and 60B are formed in Step 4 so as to be in contact with each other. In other words, the first and second conductive films 60A and 60B are formed in Step 4 such that the first conductive film 60A is connected to the first gate electrode portion 8*a* with the second conductive film 60B disposed therebetween. The gap 18 is formed between the first and second conductive films 60A and 60B by the third etching treatment in Step 5.

In the case of forming the gap 18 by controlling deposition conditions such as a deposition time in Step 4, a contact micro-portion (leakage source) between the first and second conductive films 60A and 60B can be present in the recessed portion 60. The third etching treatment is to be performed in Step 5 after Step 4.

In one embodiment, the first and second conductive films 60A and 60B may be made of the same material or different materials. The first and second conductive films 60A and 60B are formed from the same material at the same time because of the ease of manufacture and etching controllability.

A material for forming the first conductive film 60A and/or the second conductive film 60B, that is, a material contained in the structure 3, may be a conductive material having field emission properties and is selected from refractory materials with a melting point of 2,000° C. or higher. The material for forming the first conductive film 60A and/or the second conductive film 60B, that is, the material contained in the structure 3, is one which has a work function of 5 eV or less and of which an oxide can be readily etched. Examples of this material include metals such as Hf, V, Nb, Ta, Mo, W, Au, Pt, and Pd; alloys of these metals; carbides of these metals; borides of these metals; nitrides of these metals. The material for forming the first conductive film 60A and/or the second conductive film 60B may be Mo or W because there is a possibility that surface oxide layers are etched by making use of differences in etching properties between a metal and a metal oxide in Step 5.

(About Step 5)

The third etching treatment may be dry or wet etching. Wet etching is performed in Step 5 in consideration of the ease of setting etching selectivity to other materials.

The amount of etching (the size d of the gap 18) is slight, about several nanometers. Therefore, the rate of etching is not more than 1 nm per minute in consideration of stability. The term "rate of etching" as used herein means the change in thickness per unit time. The number of atoms removed by etching per unit time solely depends on the etching solution and the material for forming the first conductive film 60A and/or the second conductive film 60B. Therefore, the density and etching rate of a film are in inverse proportion to each other, that is, an increase in the density of a film reduces the etching rate thereof.

The formation of the gap 18 and the sharpening of end portion (the bump portion) of the first conductive film 60A by the third etching treatment are described below with reference to FIGS. 10A to 10C.

Figure 10A:
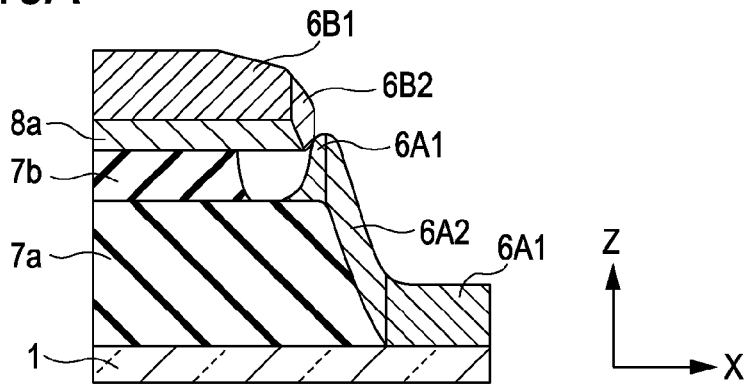
FIGS. 10A to 10C are schematic views illustrating steps of fabricating an electron-emitting device.

FIG. 10A shows a situation in which the first and second conductive films 60A and 60B are formed by the directional deposition process in Step 4. Particles sputtered by a directional sputtering process collide with the upper surface of the first gate electrode portion 8*a*, the upper surface of the substrate 1, the corner portion 32 of the first insulating sub-layer 7*a*, and the upper surface of the first insulating sub-layer 7*a* at an angle of about 90 degrees, the angle being formed by each of these surfaces and portions and the traveling direction of the sputtered particles. The term "sputtered particles" as used herein means particles sputtered from a sputtering target. Good films (herein referred to as "high-density films" or "films with high density") are formed on the above surfaces and portions.

The sputtered particles collide with a slope of the first insulating sub-layer 7*a* and an end surface of the gate electrode 8 at a shallow angle and therefore low-density films (or films with low density) are formed on the slope and the surface.

With reference to FIG. 10A, reference numeral 6A1 represents a high-density portion of the first conductive film 60A, reference numeral 6B1 represents a high-density portion of the second conductive film 60B, reference numeral 6A2 represents a low-density portion of the first conductive film 60A, and reference numeral 6B2 represents a low-density portion of the second conductive film 60B.

The density and etching rate of a film are in inverse proportion to each other as described above. Therefore, in the third etching treatment, the low-density portion 6A2 of the first conductive film 60A and the low-density portion 6B2 of the second conductive film 60B are higher in etching rate than the high-density portion 6A1 of the first conductive film 60A and the high-density portion 6B1 of the second conductive film 60B. In Step 5, all uncovered surfaces of the first and second conductive films 60A and 60B are exposed to the etchant (etched).

Figure 10B:
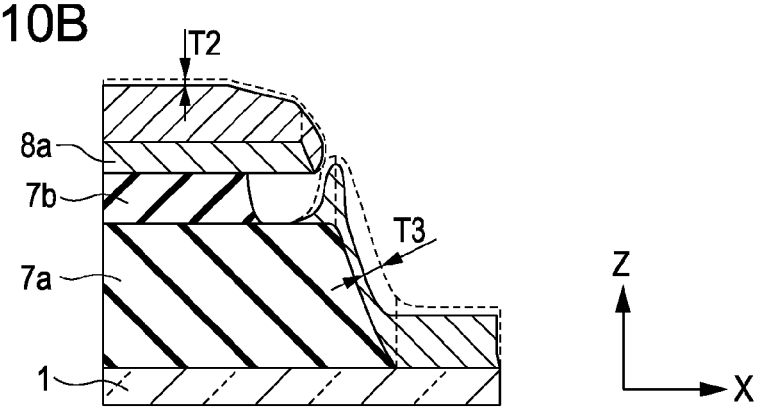
Figure 10C:
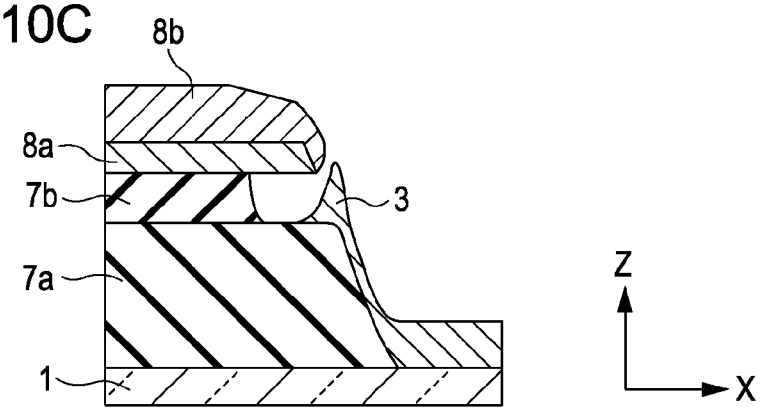

FIGS. 10B and 10C show the third etching treatment. With reference to FIG. 10B, T2 represents the reduction of the thickness of the high-density portion 6B1 of the second conductive film 60B treated by the third etching treatment and T3 represents the reduction of the thickness of the low-density portion 6A2 of the first conductive film 60A treated by the third etching treatment. In this embodiment, the inequality T2<T3 holds. The reduction of the thickness of these portions can be adjusted by controlling the time of etching or the number of times etching is repeated. Since the inequality T2<T3 holds, an end portion (the bump portion) of the first conductive film 60A is sharpened by repeatedly performing etching as shown in FIG. 10C.

In one embodiment, when the first and second conductive films 60A and 60B are made of molybdenum, the high-density portion 6A1 of the first conductive film 60A and the high-density portion 6B1 of the second conductive film 60B have a density of approximately 9.5 to 10.2 g/cm$^3$ and the low-density portion 6A2 of the first conductive film 60A and the low-density portion 6B2 of the second conductive film 60B have a density of approximately 7.5 to 8.0 g/cm$^3$. These densities are within a practical range determined in consideration of the resistivities and thicknesses of the first and second conductive films 60A and 60B (the low-density portion 6A2 of the first conductive film 60A and the low-density portion 6B2 of the second conductive film 60B are formed on slopes and therefore are small in thickness) and the difference in etching rate between the first and second conductive films 60A and 60B.

In general, an X-ray reflectivity technique (XRR technique) is used to measure the density of a film. However, it can be difficult to use the XRR technique to measure the density of a film included in an actual electron-emitting device. In such a case, for example, the following technique can be used: a technique in which films are subjected to quantitative elemental analysis using a high-resolution electron energy-loss spectroscopy microscope, which is a combination of a transmission electron microscope (TEM) and electron energy-loss spectroscopy (EELS), a calibration curve is prepared by comparing the analysis data to the densities of the films, and the density of a film is calculated from the calibration curve.

The combination of the material for forming the first conductive film 60A and/or the second conductive film 60B and the etchant used in the third etching treatment is not particularly limited. When the first and second conductive films 60A and 60B are made of molybdenum, the etchant used may be an alkali solution such as a tetramethylammonium hydroxide (TMAH) solution or aqueous ammonium, a mixture of 2-(2-n-butoxyethoxy)ethanol and an alkanolamine, dimethyl sulfoxide (DMSO), or the like.

When the first and second conductive films 60A and 60B are made of tungsten, the etchant used may be nitric acid, hydrofluoric acid, a sodium hydroxide solution, or the like.

Step 5 may include an oxidation sub-step of surface-oxidizing the first and second conductive films 60A and 60B and an etching sub-step of surface-etching the oxidized first and second conductive films 60A and 60B.

This is effective in enhancing the uniformity (reproducibility) of the amount of etching because an amount of oxide films are formed on the first and second conductive films 60A and 60B and then etched off.

The amount of oxidation (the thickness of an oxide film) is inversely proportional to the density of a film. That is, the amount of oxidation of a surface portion with high density is less than the amount of oxidation of a surface portion with low density. Therefore, when the first and second conductive films 60A and 60B are oxidized, a surface sub-portion of the low-density portion 6A2 of the first conductive film 60A and a surface sub-portion of the low-density portion 6B2 of the second conductive film 60B, which is shown in FIG. 10A, are primarily or selectively oxidized. The combination of the oxidation sub-step and the etching sub-step allows an end portion (the bump portion) of the first conductive film 60A to be sharpened and also allows the accuracy of controlling the distance of the gap 18 to be enhanced.

The first conductive film 60A is surface-oxidized to a depth of several nanometers to several tens of nanometers and a process for oxidizing the first conductive film 60A is not particularly limited. Examples of the oxidizing process include ozone oxidation (excimer UV exposure, low-pressure mercury discharge, or corona discharge) and heat oxidation. Excimer UV exposure is used because of the superior in quantitative oxidation. When the first conductive film 60A is made of molybdenum, there may be a benefit in that $MoO_3$ films that are oxide films readily removed by excimer UV exposure can be primarily produced.

In one embodiment, a process for removing oxide films may be dry or wet and is wet extending. An object of the oxide film-removing process (etching process) is to remove (etch) the oxide films, which are surface layers. Therefore, an etchant used is one which is capable of removing the oxide films only and which has substantially no influence on metal layers (unoxidized layers) disposed thereunder. Alternatively, the etchant is one which has an etching rate that is sufficiently larger (different in order magnitude) with respect to the oxide layers than the metal layers (unoxidized layers). In particular, the etchant is a diluted TMAH solution with a concentration of 0.238% or less, hot water with a temperature of 40° C. or higher, or the like when the first and second conductive films 60A and 60B are made of molybdenum. The etchant is buffered hydrofluoric acid, dilute hydrochloric acid, hot water, or the like when the first and second conductive films 60A and 60B are made of tungsten.

In Step 5, the structure 3 and the second gate electrode portion 8*b* are formed as shown in FIG. 10C. The second gate electrode portion 8*b* extends on the first gate electrode portion 8*a* (in particular, the second gate electrode portion 8*b* extends over the upper surface and side surface (slope) of the first gate electrode portion 8*a*). The second gate electrode portion 8*b* (a sub-portion of the second gate electrode portion 8*b* that is located on the side surface of the first gate electrode portion 8*a*) can be regarded as a portion that is first bombarded with electrons emitted from the tip of the bump portion of the structure 3. Therefore, electron-emitting properties of the electron-emitting device 10 can be prevented from being deteriorated in such a manner that the second gate electrode portion 8*b* is formed from a material with a high melting point, even if the first gate electrode portion 8*a* is formed from a material with a low melting point.

(About Step 6)

The cathode electrode 2, as well as the first gate electrode portion 8*a*, is conductive and can be formed by a common vapor deposition process such as a vapor deposition process or a sputtering process. A material for forming the cathode electrode 2 may be the same as or different from a material for forming the first gate electrode portion 8*a*. The cathode electrode 2 has a thickness of approximately several tens of nanometers to several hundreds of micrometers or even several hundreds of nanometers to several micrometers.

As described above, according to this embodiment, the electron-emitting device 10 field-emit electrons from first electrode side thereof when a voltage is applied between a first electrode (the cathode electrode 2) and a second electrode (the gate electrode 8) spaced from the first electrode. In the case of applying electrons from the electron-emitting device 10 to an anode electrode different from the gate electrode 8, the anode electrode is spaced from the substrate 1, which is shown in FIGS. 1, 2, and 5. A potential sufficiently higher than the potential applied to the gate electrode 8 is applied to the anode electrode. This allows electrons (field-emitted electrons) extracted by the gate electrode 8 to be applied to the anode electrode. The electron-emitting device 10 has a three-terminal structure (cathode electrode/gate electrode/anode electrode structure). The distance between the anode electrode and the substrate 1 is sufficiently greater than the distance between the cathode electrode 2 and the gate electrode 8 and is approximately 500 μm to 2 mm.

The fluctuation of an emission current emitted from the electron-emitting device 10 shows the amplitude of the temporal variation of the emission current. For example, currents emitted by the periodic application of rectangular pulse voltages vary and the fluctuation of the currents can be determined in such a manner that the amplitude of the variation of each current per unit time is represented by a deviation and the deviation is divided by the average of the currents.

In particular, a rectangular pulse voltage having a pulse width of 6 ms and a frequency of 24 ms is continuously applied to an electron-emitting device. Sequences for measuring the average of emission currents corresponding to continuous 32 cycles of the rectangular pulse voltage are performed at intervals of two seconds and deviations for 30 minutes and the average thereof are determined. In the case of comparing a plurality of electron-emitting devices for the amplitude of fluctuation, the peak values of voltages applied thereto are set such that the averages of currents emitted from the electron-emitting devices are substantially equal to each other.

Figure 6:
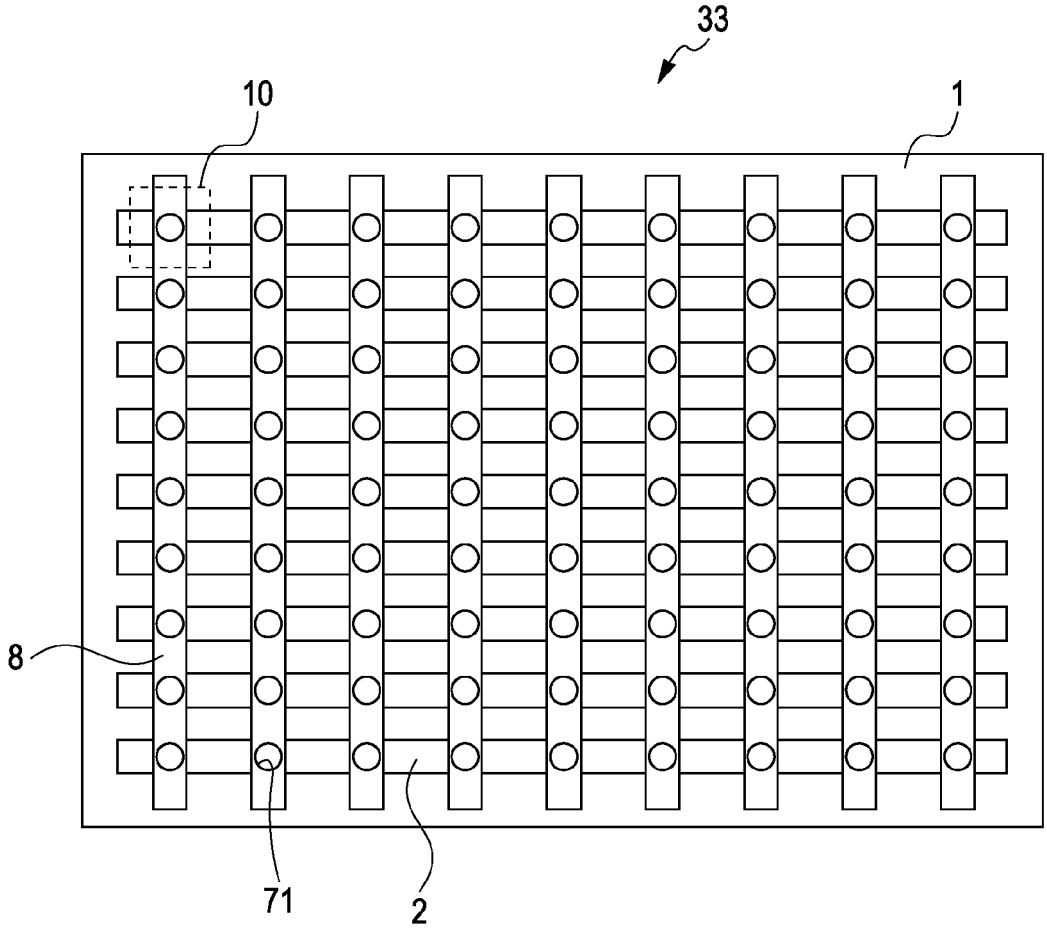
FIG. 6 is a plan view of an electron source.

An exemplary electron source 33 according to a third embodiment of the present invention will now be described with reference to FIG. 6. FIG. 6 is a plan view of the electron source 33. The electron source 33 includes a substrate 1 and a large number of electron-emitting devices 10 which are arranged on the substrate 1 and which include conical electron-emitting members 9 as shown in FIGS. 1 and 2.

The electron source 33 includes the substrate 1 and the electron-emitting devices 10 arranged on the substrate 1 as described above. The substrate 1 may be insulating and is made of glass. With reference to FIG. 6, the electron-emitting devices 10, which are described above with reference to FIG. 1, are arranged on the substrate 1 in a matrix pattern. The electron-emitting devices 10 may be those shown in FIGS. 3 and 5.

The electron-emitting devices 10 arranged in each column are commonly connected to a corresponding one of gate electrodes 8. The electron-emitting devices 10 arranged in each row are commonly connected to a corresponding one of cathode electrodes 2. Electrons can be emitted from a predetermined number of the electron-emitting devices 10 in such a manner that a predetermined number of the cathode and gate electrodes 2 and 8 are selected and voltages are applied between the selected cathode and gate electrodes 2 and 8.

In this embodiment, one of the electron-emitting devices 10 is located at an intersection of one of the cathode electrodes 2 and one of the gate electrodes 8. Some of the electron-emitting devices 10 may be located at the intersection thereof. In the case of using the electron-emitting devices 10 as shown in FIGS. 1 and 2, a plurality of first openings 71 are located at each of intersections of the cathode and gate electrodes 2 and 8 and electron-emitting members 9 are each placed in a corresponding one of the first openings 71.

FIG. 6 shows a simple example in which each first opening 71 is located at a corresponding one of intersections of the cathode and gate electrodes 2 and 8. In order to reduce fluctuations in emission currents, the number of the electron-emitting devices 10 located at each of the intersections thereof is large. This is because fluctuations in emission currents are averaged when the number of the electron-emitting devices 10 located at the intersections thereof is large. However, in view of fabrication, it is not preferred that an excessive number of the electron-emitting devices 10 are located at each of the intersections thereof. Since the electron-emitting devices 10 are fabricated by a method according to the present invention, fluctuations in emission currents can be reduced, that is, such fluctuations can be reduced without increasing the number of the electron-emitting devices 10.

An exemplary image display panel 100 according to a fourth embodiment will now be described with reference to FIG. 7. The image display panel 100 includes the electron source 33 according to the third embodiment. In this example, a plurality of the electron-emitting devices 10 are located at each of intersections of the cathode and gate electrodes 2 and 8.

The image display panel 100 includes an inner portion maintained at a pressure (vacuum) less than atmospheric pressure and therefore can be translated into an airtight container.

Figure 7:
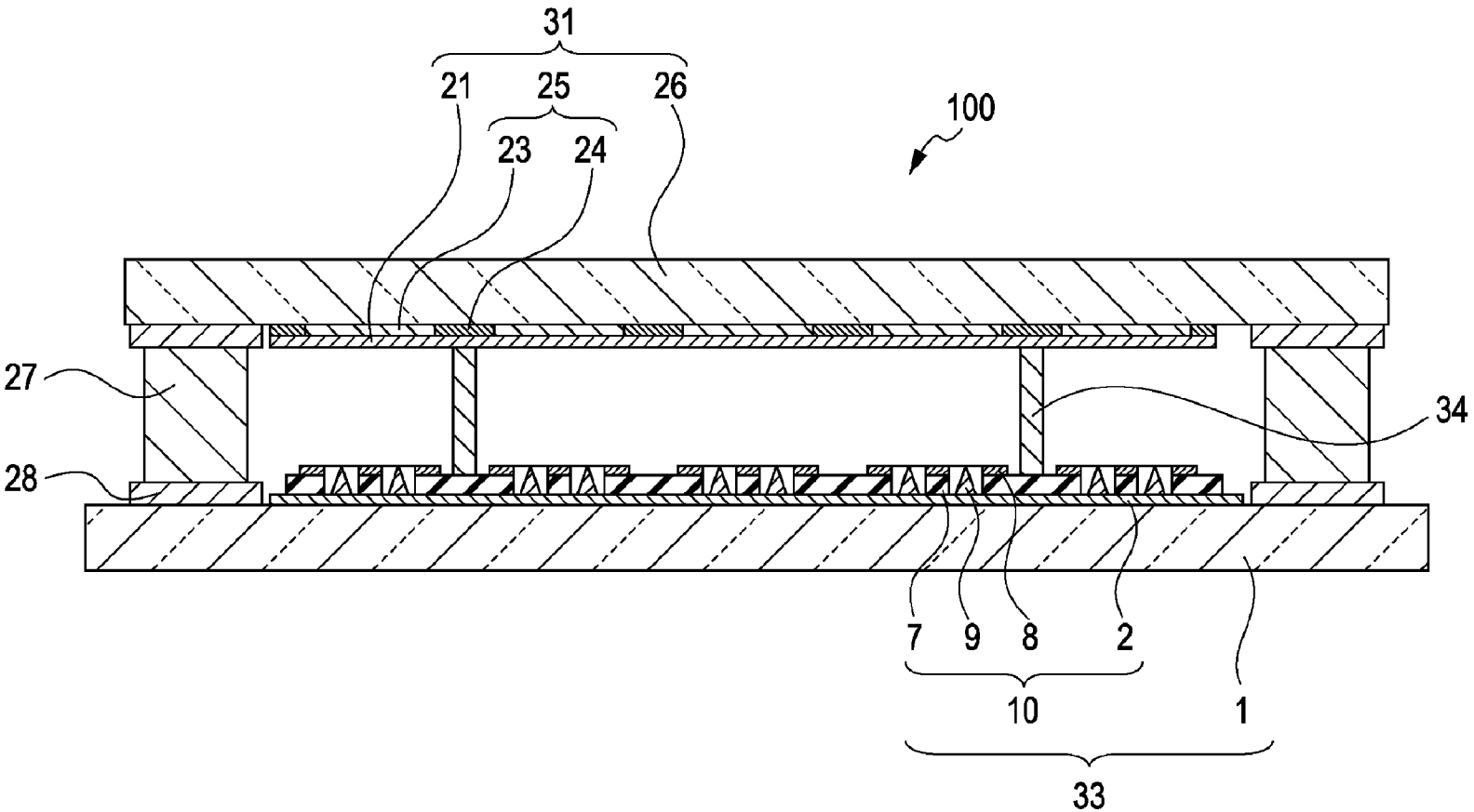
FIG. 7 is a schematic sectional view of an image display panel.

FIG. 7 is a schematic sectional view of the image display panel 100. The image display panel 100 includes the electron source 33. The electron source 33 is used as a back plate in this embodiment. A front plate 31 is disposed opposite the back plate 33.

In one embodiment, a support frame 27 with a closed ring shape (rectangular shape) is disposed between the front plate 31 and the back plate 33 such that the front plate 31 and the back plate 33 are spaced from each other at a predetermined distance. The distance between the front plate 31 and the back plate 33 is typically 500 μm to 2 mm and is about 1 mm for practical use. The front plate 31 and the back plate 33 are air-tightly bonded to the support frame 27 with bonding members 28, made of indium or glass frit, having a sealing function. The support frame 27 serves to seal the inner portion of the image display panel 100. When the image display panel 100 has a large area, the image display panel 100 contains a plurality of spacers 34 arranged between the front plate 31 and the back plate 33 such that the distance between the front plate 31 and the back plate 33 can be kept constant.

The front plate 31 includes a light-emitting layer 25 including light-emitting members 23 that emit light when being bombarded with electrons emitted from the electron-emitting devices 10, an anode electrode 21 disposed on the light-emitting layer 25, and a transparent substrate 26.

The transparent substrate 26 transmits light emitted from the light-emitting layer 25 and therefore is made of, for example, glass.

The light-emitting members 23 may contain a common phosphor. When the light-emitting layer 25 includes first light-emitting members emitting red light, second light-emitting members emitting green light, and third light-emitting members emitting blue light, the image display panel 100 can display a full-color image. With reference to FIG. 7, the light-emitting layer 25 includes a black member 24 having portions disposed between the light-emitting members 23. The black member 24 is usually referred to as a black matrix and is a member for increasing the contrast of a displayed image.

The electron-emitting devices 10, which emit electrons toward the light-emitting members 23, are arranged opposite the light-emitting members 23. That is, each of the electron-emitting devices 10 corresponds to a corresponding one of the light-emitting members 23.

The anode electrode 21 is usually referred to as a metal back and may typically include an aluminum film. The anode electrode 21 may be disposed between the light-emitting layer 25 and the transparent substrate 26. In this case, the anode electrode 21 is made from an optically transparent, conductive film such as an indium tin oxide (ITO) film.

In a step (bonding or seal-bonding step) of air-tightly bonding the front plate 31 and the back plate 33 together, members of the image display panel 100, which is an airtight container, are heated.

In the bonding step (or seal-bonding step), the support frame 27 attached to the bonding members 28, which are made of glass frit or the like, is provided between the front plate 31 and the back plate 33. The front plate 31, the back plate 33, and the support frame 27 are heated at a temperature of, for example, 100° C. to 400° C. while being pressed against each other and are then cooled to room temperature. In advance of the bonding step, the back plate 33 may be degassed by heating. Although the back plate 33 is heated and cooled, low-work function layers 5 are not separated from the electron-emitting members 9 as described in the first embodiment.

An image display apparatus 200 according to a fifth embodiment of the present invention will now be described with reference to FIG. 8. The image display apparatus 200 includes the image display panel 100 according to the fourth embodiment and a driving circuit 110, connected to the image display panel 100, for driving the image display panel 100. The image display apparatus 200 may be connected to an image signal output apparatus 400 that outputs an information signal such as a television broadcast signal or a signal stored in an information storage device in the form of an image signal, whereby an information display system 500 can be structured. In other words, the information display system 500 includes the image signal output apparatus 400.

The image display apparatus 200 includes the image display panel 100 and the driving circuit 110 at least and further includes a control circuit 120. The control circuit 120 subjects an input image signal to a process, such as a correction process, suitable for the image display panel 100 and outputs the image signal and various control signals to the driving circuit 110. The driving circuit 110 outputs driving signals to lines, such as the cathode and gate electrodes 2 and 8 shown in FIG. 3, arranged in the image display panel 100 on the basis of the input image signal. The driving circuit 110 includes a modulation sub-circuit for converting the image signal into a driving signal and also includes a scanning sub-circuit for selecting the lines. The driving signal output from the driving circuit 110 controls voltages applied to the electron-emitting devices 10, which correspond to pixels arranged in the image display panel 100. This allows the pixels to emit light with a luminance corresponding to the image signal, thereby displaying an image on a screen. The screen corresponds to the light-emitting layer 25, which is disposed in the image display panel 100 as shown in FIG. 7.

Figure 8:
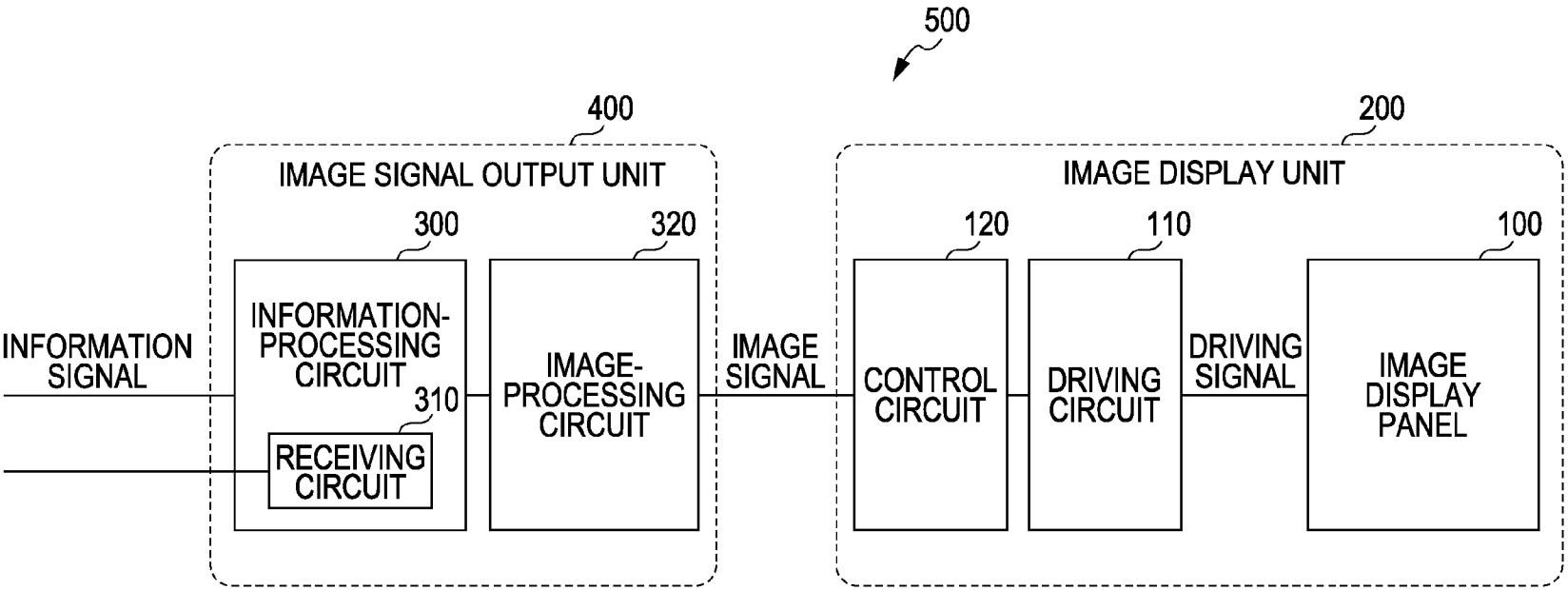
FIG. 8 is a block diagram of an information display system.

FIG. 8 is a block diagram of the information display system 500. The information display system 500 includes the image signal output apparatus 400 and the image display apparatus 200. The image signal output apparatus 400 includes an information-processing circuit 300 and further includes an image-processing circuit 320. The image signal output apparatus 400 may be disposed in a housing separately from the image display apparatus 200 or at least one portion of the image signal output apparatus 400 and the image display apparatus 200 may be disposed in the same housing. The configuration of the information display system 500 is for exemplification only and may be varied.

The following signals are input to the information-processing circuit 300: television broadcast signals such as satellite broadcast signals and terrestrial signals, information signals such as data broadcast signals transmitted through wireless communication networks, telecommunication networks, digital networks, analogue networks, or telecommunication lines such as the internet with the TCP/IP protocol. The information-processing circuit 300 may be connected to a storage device such as a semiconductor memory, an optical disk drive, or a magnetic storage device such that the information stored in such a storage device can be displayed on the image display panel 100. Alternatively, the information-processing circuit 300 may be connected to an image input device such as a video camera, a still camera, or a scanner such that the information obtained such an image input device can be displayed on the image display panel 100. The information-processing circuit 300 may be connected to a system such as a video conference system or a computer system.

An image displayed on the image display panel 100 may be output to a printer or stored in a memory device.

The information contained in the information signal is at least one of image information, text information, and sound information. The information-processing circuit 300 may include a receiving sub-circuit 310 including a tuner for selecting information from broadcast signals and/or a decoder for decoding the information signal if the information signal has been encoded.

The image signal obtained from the information-processing circuit 300 is output to the image-processing circuit 320. The image-processing circuit 320 may include a sub-circuit, such as a gamma-correction sub-circuit, a resolution conversion sub-circuit, an interface sub-circuit, for processing the image signal in various ways. The image signal is converted into a signal format for the image display apparatus 200 and then displayed on the image display apparatus 200.

The image or text information output to the image display panel 100 can be displayed on a screen as described below. For example, image signals corresponding to the pixels of the image display panel 100 are generated from the image or text information input to the information-processing circuit 300. The generated image signals are input to the control circuit 120 of the image display apparatus 200. Voltages to be applied to the electron-emitting devices 10, which are arranged in the image display panel 100, from the driving circuit 110 are controlled on the basis of the image signals input to the control circuit 120. Sound signals are output to a sound reproducer (not shown) such as a speaker and then reproduced synchronously with the image or text information displayed on the image display panel 100.

According to this embodiment, stable emission currents can be obtained from the electron-emitting devices 10 and therefore the quality of an image displayed on the image display apparatus 200 can be enhanced.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer, for example, via a network or from a recording medium of various types serving as the memory device (e.g., computer-readable medium).

EXAMPLES

Examples of the present invention will now be described.

Example 1

A method of fabricating electron-emitting device and the electron-emitting device is described below with reference to FIG. 1. The electron-emitting device includes a structure with a conical shape.

The following electrode and layers were formed on a substrate 1 made of glass in this order as shown in FIG. 1A: a cathode electrode 2 made of niobium; an insulating material layer 70, made of silicon dioxide, having a thickness of about 1 μm; and a conductive material layer 80 made of niobium.

A circular second opening 81 with a diameter of about 1 μm was formed in the conductive material layer 80 by an ion etching process, whereby a gate electrode 8 was formed as shown in FIG. 1B.

The insulating material layer 70 was etched using the gate electrode 8 as a mask, whereby a circular first opening 71 was formed as shown in FIG. 1C.

A sacrificial layer 82 made of nickel was provided on the gate electrode 8 as shown in FIG. 1D. Molybdenum was deposited in the first opening 71 so as to form a cone, whereby a structure 3 made of molybdenum was formed as shown in FIG. 1E.

The sacrificial layer 82 was selectively removed, whereby an unnecessary molybdenum layer 30 deposited on the sacrificial layer 82 was also removed and a configuration shown in FIG. 1F was obtained.

The substrate 1 carrying the structure 3 shown in FIG. 1F was moved into a vacuum chamber and a molybdenum oxide layer, that is, a metal oxide layer 4 was then formed on the structure 3 by a sputtering process using a molybdenum oxide target so as to have a thickness of about 4 nm as shown in FIG. 1G.

A polycrystalline layer 5 of lanthanum hexaboride was formed on the metal oxide layer 4 by an RF sputtering process so as to have a thickness of 10 nm, whereby the electron-emitting device were formed as shown in FIG. 1H. Conditions for forming the polycrystalline layer 5 of lanthanum boride were as follows: an Ar pressure of 1.5 Pa during RF sputtering, an RF power supply of 250 W, and an RF power of 250 W. The polycrystalline layer 5 had a crystallite size of 7 nm and a work function of 2.85 eV.

The size of crystallites can be controlled by controlling sputtering conditions, particularly the Ar pressure and power used. If the Ar pressure used for RF sputtering is set to 2.0 Pa, the RF power supply and RF power used are both set to 800 W, and the thickness of a layer to be formed is set to 7 nm, the crystallite size and work function of the layer can be adjusted to 2.5 nm and 2.85 eV, respectively. If the Ar pressure used for DC sputtering is set to 1.5 Pa, the RF power supply and RF power used are both set to 250 W, and the thickness of a layer to be formed is set to 20 nm, the crystallite size and work function of this layer can be adjusted to 10.7 nm and 2.8 eV, respectively. For conditions for forming the 7-nm thick layer, the integral intensity ratio $I_{(100)}/I_{(110)}$ of diffraction peaks observed by X-ray diffraction is 0.54 and well coincides with data (JCPDS #34-0427) obtained from a non-oriented sample. This proves that a lanthanum boride layer 5 prepared herein is a non-oriented polycrystalline layer with random orientation. An increase in thickness promotes the orientation corresponding to a diffraction peak assigned to the (100) plane. For a thickness of more than 20 nm, typically 30 nm or more, the integral intensity ratio $I_{(100)}/I_{(110)}$ is more than 2.8. For a thickness of 20 nm or less, the integral intensities of planes other than the (100) and (200) planes are less than the integral intensities of the (100) and (200) planes. An increase in thickness increases the size of crystallites. When the crystallite size of a layer is less than 2.5 nm, the work function thereof is more than 3.0 eV probably because of incapability of maintaining crystallinity.

The electron-emitting device was placed into a vacuum apparatus, which was evacuated to $10^{-8}$ Pa. Rectangular pulse voltages having a pulse width of 6 ms and a frequency of 25 Hz were repeatedly applied between the cathode electrode 2 and the gate electrode 8 such that the gate electrode 8 had a higher potential. The gate current flowing through the gate electrode 8 was monitored. An anode plate was provided at a position 5 mm above the substrate 1, the current (anode current) flowing into the anode plate was also monitored, and the fluctuation in the anode current was determined. The fluctuation in the emission current (anode current) was determined in such a manner that sequences for measuring the average of the emission currents corresponding to continuous 32 cycles of a rectangular pulse voltage are performed at intervals of two seconds and deviations for 30 minutes and the average thereof are determined. The obtained data was calculated for (standard deviation/average×100(%)).

For comparison, the following devices were prepared and then measured in substantially the same manner as the above: comparative electron-emitting devices including no metal oxide layers 4, made of molybdenum oxide, between structures 3 and low-work function layers 5 made of polycrystalline lanthanum hexaboride.

The electron-emitting device and comparative electron-emitting devices fabricated as described above were measured in substantially the same manner as the above. As a result, the electron-emitting device, which included the metal oxide layer 4 made of molybdenum oxide, had an average current fluctuation that was 0.6 times that of the comparative electron-emitting devices, which included no metal oxide layers 4. Data was obtained from a plurality of electron-emitting device. This showed that the difference (deviation) between the electron-emitting devices was 0.5 times that between the comparative electron-emitting devices.

Since the electron-emitting device include the metal oxide layer 4, which is made of molybdenum oxide, the electron-emitting device has a small fluctuation in current and can operate stably and differences in properties between the electron-emitting devices are small.

Example 2

In this example, an electron-emitting device including structure 3 made of tungsten was fabricated. A step of forming a sacrificial layer 82 made of nickel on a gate electrode 8 and steps prior to this step (a step shown in FIG. 1D and steps prior to this step) were substantially the same as those described in Example 1.

Molybdenum was deposited in an opening 71 so as to form a cone, whereby the structure 3 made of tungsten were formed as shown in FIG. 1E. The sacrificial layer 82 was selectively removed, whereby an unnecessary tungsten layer 30 deposited on the sacrificial layer 82 was also removed and a configuration shown in FIG. 1F was obtained.

The structure 3 shown in FIG. 1F was moved into a vacuum chamber and a tungsten oxide layer, that is, a metal oxide layer 4 was then formed on the structure 3 by a sputtering process using a tungsten oxide target so as to have a thickness of about 4 nm as shown in FIG. 1G.

A polycrystalline layer 5 of lanthanum hexaboride was formed on the metal oxide layer 4 by an RF sputtering process so as to have a thickness of 10 nm, whereby the electron-emitting device were formed as shown in FIG. 1H.

The electron-emitting device was placed into a vacuum apparatus and then measured for fluctuation in anode current in substantially the same manner as that described in Example 1. For comparison, the following devices were prepared and then measured in substantially the same manner as the above: comparative electron-emitting devices including no metal oxide layers 4 between structures 3 and low-work function layers 5 made of polycrystalline lanthanum hexaboride.

As a result, the electron-emitting device, which included the metal oxide layer 4 made of molybdenum oxide, had an average current fluctuation that was 0.7 times that of the comparative electron-emitting devices, which included no metal oxide layers 4. Data was obtained from electron-emitting devices and the comparative electron-emitting devices. This showed that the difference (deviation) between the electron-emitting devices was 0.6 times that between the comparative electron-emitting devices. Since the electron-emitting device include the metal oxide layer 4, which is made of molybdenum oxide, the electron-emitting device has a small fluctuation in current, can operate stably, and has small differences between properties.

Example 3

In this example, the following device was fabricated: an electron-emitting device that was substantially the same as that fabricated in Example 1 except that the electron-emitting device included a molybdenum oxide layer 4 containing lanthanum.

The electron-emitting device was fabricated in substantially the same manner as that described in Example 1 except that the metal oxide layer 4 was formed by a sputtering process using a target containing molybdenum oxide and lanthanum in a step shown in FIG. 1G so as to have a thickness of 6 nm. The electron-emitting device was analyzed by X-ray photoelectron spectroscopy (XPS). As a result, the content of lanthanum in the metal oxide layer 4 was ten atomic percent and lanthanum and an oxide of lanthanum was detected. The metal oxide layer 4 contained $MoO_2$.

The electron-emitting device was measured in substantially the same manner as that described in Example 1. As a result, the electron-emitting device had an electron emission threshold voltage less than that of that fabricated in Example 1.

A sample was prepared in such a manner that a molybdenum oxide layer 4 containing lanthanum and a polycrystalline layer of lanthanum hexaboride were formed on a molybdenum layer disposed on a flat substrate in that order by substantially the same process as that used in this example. A comparative sample was prepared in such a manner that a molybdenum oxide layer containing no lanthanum and a polycrystalline layer of lanthanum boride were formed in that order by substantially the same process as that used in Example 1. The thickness-wise resistance of the sample, which included the molybdenum oxide layer containing lanthanum, was one or more orders of magnitude less than that of the comparative sample. This is probably because the molybdenum oxide layer 4 of the electron-emitting device contains lanthanum and therefore the electron-emitting device has a reduced resistance and a reduced electron emission threshold voltage.

Example 4

In this example, the following device was fabricated: an electron-emitting device that was substantially the same as that fabricated in Example 2 except that the electron-emitting device included a metal oxide layer 4 containing tungsten oxide and lanthanum.

The electron-emitting device was fabricated in substantially the same manner as that described in Example 2 except that the metal oxide layer 4 was formed by a sputtering process using a target containing tungsten oxide and lanthanum in a step shown in FIG. 1G so as to have a thickness of 6 nm. The electron-emitting device was analyzed by XPS. As a result, the content of lanthanum in the metal oxide layer 4 was ten atomic percent. Lanthanum and an oxide of lanthanum were detected in the metal oxide layer 4. The metal oxide layer 4 contained $WO_2$.

The electron-emitting device was measured in substantially the same manner as that described in Example 1. As a result, the electron-emitting device had an electron emission threshold voltage less than that of that fabricated in Example 2.

A sample was prepared in such a manner that a tungsten oxide layer containing lanthanum and a polycrystalline $LaB_6$ layer were formed on a tungsten layer disposed on a flat substrate in that order by substantially the same process as that used in this example. A comparative sample was prepared in such a manner that a tungsten oxide layer containing no lanthanum and a polycrystalline $LaB_6$ layer were formed in that order by substantially the same process as that used in Example 2. The thickness-wise resistance of the sample, which included the molybdenum oxide layer containing lanthanum, was one or more orders of magnitude less than that of the comparative sample. This is probably because the tungsten oxide layer of the sample contains lanthanum and therefore the sample has a reduced resistance and a reduced electron emission threshold voltage.

Example 5

In this example, the following device was fabricated: an electron-emitting device that was substantially the same as that fabricated in Example 3 except that the electron-emitting device included a lanthanum oxide layer 6 disposed on a polycrystalline layer 5 of lanthanum boride.

A step of forming the polycrystalline layer 5 of lanthanum boride and steps prior to this step (a step shown in FIG. 1H and steps prior to this step) were substantially the same as those described in Example 3. The lanthanum oxide layer 6 was formed on the polycrystalline layer 5 of lanthanum boride by depositing dilanthanum trioxide on the polycrystalline layer 5 of lanthanum boride by a sputtering process so as to have a thickness of about 3 nm, whereby the electron-emitting devices were fabricated.

The electron-emitting device was measured in substantially the same manner as that described in Example 3. As a result, the electron-emitting device had an average current fluctuation that was 0.7 times that of that fabricated in Example 3. Data was obtained from a plurality of electron-emitting devices. This showed that the difference (deviation) between the electron-emitting devices was 0.7 times that between that fabricated in Example 3.

Since the lanthanum oxide layer 6 is disposed on the constraining layer 5 of lanthanum boride, the electron-emitting device has a small fluctuation in current, can operate stably, and has differences between properties. Lanthanum oxide layers 6 were formed on the low-work function layers 5 of the electron-emitting devices of Examples 1, 2, and 4. The resulting electron-emitting devices, as well as those of this example, were superior in stability to electron-emitting devices including no lanthanum oxide layers 6.

Example 6

In this example, the following devices were fabricated: electron-emitting devices that were substantially the same as that fabricated in Example 2 except that the electron-emitting devices included low-work function layers 5 made of diyttrium trioxide ($Y_2O_3$).

$Y_2O_3$ was formed in such a manner that amorphous $Y_2O_3$ layers with a thickness of 15 nm were formed by an ion plating process and a substrate 1 was heated at 400° C. in an argon atmosphere containing 21% oxygen.

The electron-emitting devices are inferior in emission current and stability to that fabricated in Example 2 but are superior in electron-emitting properties to that fabricated in Example 2. The electron-emitting devices can operate stably and differences in properties between the electron-emitting devices are less than those between comparative electron-emitting devices including no metal oxide layers 4.

Example 7

In this example, an electron-emitting device was fabricated as shown in FIG. 5. The following layers were deposited on a substrate 1 in this order: a silicon nitride layer for forming first insulating layers 7*a*, a silicon oxide layer for forming second insulating layers 7*b*, and a tungsten layer for forming gate electrodes 8. The silicon nitride layer and the tungsten layer were processed by a combination of photolithography and dry etching (RIE), whereby the first insulating layers 7*a* and the gate electrodes 8 were formed as shown in FIG. 5B. In this step, the first insulating layers 7*a* were formed such that side surface of the first insulating layer 7*a* formed an angle of about 80 degrees with the upper surface of the substrate 1. The silicon oxide layer was selectively wet-etched with buffered hydrofluoric acid, whereby the second insulating layers 7*b* and recessed portions 60 were formed.

Molybdenum was deposited on a side surface of the first insulating layer 7*a* by a directional sputtering process. In this step, a first conductive film 60A and second conductive films 60B were formed such that the first conductive film 60A was in contact with the second conductive films 60B as shown in FIG. 9D. Wet etching was performed using TMAH as an etchant, whereby the following structures were obtained: structures 3 including bumps, formed by depositing molybdenum near inlets of the recessed portions 60, protruding from upper surface portions of the first insulating layers 7*a* that were located in the recessed portions 60 toward first gate electrode portions 8*a*. In this step, second gate electrode portions 8*b* made of molybdenum were formed on the first gate electrode portions 8*a*.

Molybdenum oxide was deposited on the structures 3 by a sputtering process using a molybdenum oxide target in substantially the same manner as that described in Example 1, whereby molybdenum oxide layers used as metal oxide layers 4 were formed on the structures 3. Low-work function layers 5 made of polycrystalline lanthanum boride were formed on the molybdenum oxide layers under substantially the same conditions as those described in Example 1.

In this example, 200 electron-emitting members 9 with a strip shape were formed on the substrate 1 at intervals of 3 μm in a Y-direction as shown in FIG. 5C. Finally, cathode electrodes 2 made of niobium were commonly connected to the electron-emitting members 9.

Voltages were applied between the cathode electrodes 2 and the gate electrodes 8 such that the gate electrodes 8 had a higher potential, whereby uniform, good electron-emitting properties were obtained as well as those described in Example 1. The electron-emitting devices of this example were lower in electron emission threshold voltage than those of Example 1.

Since the molybdenum oxide target used to form the molybdenum oxide layers containing lanthanum as well as that used in Example 3, the electron-emitting devices emitted electrons at a lower voltage as compared to those fabricated using a target containing no lanthanum.

Lanthanum oxide layers were provided on the low-work function layers 5 by a sputtering process as well as those formed in Example 5; hence, stable electron-emitting properties were obtained over a long period of time.

Example 8

In this embodiment, an image display apparatus shown in FIG. 7 was manufactured using the electron-emitting devices of Example 3. The image display apparatus was a 50-inch diagonal flat-panel display including pixels arranged in 1,920 columns and 1,080 rows.

The electron-emitting devices of Example 3 were provided on a glass substrate 1 as shown in FIGS. 6 and 7, whereby an electron source 33 was obtained. The electron source 33 was used as a back plate. A procedure for fabricating the electron-emitting devices was as described below with reference to FIG. 1.

In particular, a molybdenum layer was formed over the glass substrate 1 by a sputtering process. The molybdenum layer was patterned, whereby cathode electrodes 2 were formed so as to be parallel to each other. The number of the cathode electrodes 2 was equal to the number of scanning lines of the image display apparatus and was 1,080.

An $SiO_2$ layer 70 was formed over the cathode electrodes 2 so as to have a thickness of 1 μm. A tungsten film was formed over the SiO2 layer 70 by a sputtering process. The tungsten film was patterned, whereby tungsten layers 80 were formed so as to intersect with the cathode electrodes 2 and so as to be parallel to each other. The number of the tungsten layers 80 was equal to the number of signal lines of the image display apparatus and was 5,760 (1,920×3) (intersections of the tungsten layers 80 and the cathode electrodes 2 were as shown in FIG. 1A in cross section).

Circular second openings 81 were formed in all the tungsten layers 80 by dry etching such that 100 of the second openings 81 were located at each of the intersections of the tungsten layers 80 and the cathode electrodes 2, whereby gate electrodes 8 were formed. First openings 71 were formed under the second openings 81 by wet etching using the gate electrodes 8 as masks such that the cathode electrodes 2 were exposed through the first openings 71 as shown in FIGS. 1B and 1C.

A nickel layer 82 was formed over the gate electrodes 8 and molybdenum was deposited thereon by sputtering, whereby structures 3, made of molybdenum, having a conical shape were formed on the cathode electrodes 2, which were exposed through the first and second openings 71 and 81, as shown in FIGS. 1D and 1E. The nickel layer 82 was removed, whereby an unnecessary molybdenum layer 30 disposed on the nickel layer 82 was also removed as shown in FIG. 1F.

In a vacuum chamber, metal oxide layers 4 were formed on the structures 3 by a sputtering process using a target prepared by adding lanthanum to molybdenum oxide in substantially the same manner as that described in Example 3 as shown in FIG. 1G. The metal oxide layers 4 contained lanthanum and molybdenum oxide and had a thickness of 3 nm.

Low-work function layers 5, made of polycrystalline $LaB_6$, having a thickness of 10 nm were provided on the metal oxide layers 4 by a sputtering process in substantially the same manner as that described in Example 3, whereby the electron source (back plate) 33, which was used as a back plate, was manufactured as shown in FIG. 1H.

As shown in FIG. 7, a front plate 31 was provided at a position 2 mm above the electron source 32 with a support frame 27 disposed therebetween. The front plate 31 included a glass substrate 22 and also included a light-emitting layer 25 and metal back 21 deposited on the inner surface of the glass substrate 22.

Bonding members 28 each disposed between the front plate 31 and the support frame 27 or between the support frame 27 and the back plate 33 were seal-bonded thereto by heating and then cooling indium (In), which is a low-melting point metal. The seal-bonding step was performed in a vacuum chamber and therefore bonding and sealing were performed at the same time without using any exhaust pipe.

In this example, in order to display a color image, the light-emitting layer 25 contained phosphors 23 each emitting red light, green light, or blue light. A black matrix 24 with a striped pattern was formed in advance and the phosphors 23 were applied to open portions of the black matrix 24 by a slurry process, whereby the light-emitting layer 25 was prepared. A material made of graphite was used to prepare the light-emitting layer 25.

The metal back 21, which was made of aluminum, was provided on the inner side (electron-emitting device side) of the light-emitting layer 25. The metal back 21 was prepared in such a manner that aluminum was vacuum-deposited on the inner sub-family of the light-emitting layer 25.

The image display apparatus was manufactured in such a manner that a driving circuit 110 shown in FIG. 8 and the like were connected to an image display panel manufactured as described above. A number of electron-emitting devices were selected and pulse voltages were applied thereto, whereby a good bright image with little fluctuation in brightness was capable of being displayed over a long period of time.

The following apparatus was capable of being manufactured using the electron-emitting devices of Example 3 instead of the electron-emitting devices of Example 5: an image display apparatus capable of displaying an image with little fluctuation in brightness over a longer period of time as compared to the image display apparatus of this example.

Furthermore, a good image display apparatus was capable of being manufactured using the electron-emitting devices of Example 7.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-307586 filed Dec. 2, 2008 and No. 2009-217330 filed Sep. 18, 2009, which are hereby incorporated by reference herein in their entirety.

What is claimed is:

1. A method of fabricating electron-emitting device including electron-emitting member which includes a structure containing a metal and a low-work function layer, made of a material with a work function less than that of the metal, overlying the structure and which field-emits electrons from a surface, the method comprising:

providing a structure containing a metal, on which a metal oxide layer containing an oxide of a same metal as the metal contained in the structure has been formed; and providing a low-work function layer on the metal oxide layer, wherein the low-work function layer is made of polycrystalline lanthanum boride, and wherein the metal is molybdenum and the metal oxide layer contains an oxide of molybdenum.

2. A method of manufacturing an image display apparatus including electron-emitting devices and light-emitting members that emit light when being bombarded with electrons emitted from the electron-emitting devices, the method comprising:

fabricating each of the electron-emitting devices by the method according to claim 1.

* * * * *